US011807016B2

(12) United States Patent
Leiser et al.

(10) Patent No.: US 11,807,016 B2
(45) **Date of Patent: *Nov. 7, 2023**

(54) PLIABLE PRINT LIQUID SUPPLY RESERVOIRS WITH OFFSET SPOUT

(71) Applicant: HEWLETT-PACKARD DEVELOPMENT COMPANY, L.P., Spring, TX (US)

(72) Inventors: Judson M. Leiser, Corvallis, OR (US); Michael E. Peterschmidt, Corvallis, OR (US); Peter R. Stokes, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/726,789

(22) Filed: Apr. 22, 2022

(65) Prior Publication Data

US 2022/0242133 A1 Aug. 4, 2022

Related U.S. Application Data

(63) Continuation of application No. 16/764,964, filed as application No. PCT/US2018/042013 on Jul. 13, 2018, now Pat. No. 11,390,089.

(51) Int. Cl.
*B41J 2/175* (2006.01)

(52) U.S. Cl.
CPC .. *B41J 2/17553* (2013.01); *B41J 2002/17516* (2013.01)

(58) Field of Classification Search
CPC ..... B41J 2/17553; B41J 2002/17516; B41J 2/17513; B41J 2/17523
USPC ..... 347/86
See application file for complete search history.

(56) References Cited

U.S. PATENT DOCUMENTS

| | | | |
|---|---|---|---|
| 4,421,146 | A | 12/1983 | Bond et al. |
| 4,917,269 | A | 4/1990 | Fuchs et al. |
| 4,938,510 | A | 7/1990 | Gmeiner et al. |
| 5,107,909 | A | 4/1992 | Donovan |
| 5,224,614 | A | 7/1993 | Bono et al. |
| 5,299,718 | A | 4/1994 | Shwery |
| 5,751,320 | A | 5/1998 | Scheffelin et al. |

(Continued)

FOREIGN PATENT DOCUMENTS

| | | | |
|---|---|---|---|
| CN | 1520323 | A | 8/2004 |
| CN | 1764402 | A | 4/2006 |

(Continued)

OTHER PUBLICATIONS

"Plastic Kitchen Cabinet Adjustable Leg Clips," Dongguan Meizhong Plastic & Metal Products Co. Ltd, retrieved at https://www.exportersindia.com/dongguan-meizhong-plastic-metal-products/plastic-kitchen-cabinet-adjustable-leg-clips-china-931438.htm, retrieved on Mar. 23, 2022, 2 pages.

(Continued)

*Primary Examiner* — Matthew Luu
*Assistant Examiner* — Alexander D Shenderov
(74) *Attorney, Agent, or Firm* — Foley & Lardner LLP

(57) ABSTRACT

In one example in accordance with the present disclosure, a print liquid supply is described. The print liquid supply includes a reservoir for holding a supply of print liquid. The reservoir includes a pliable body having a front face and a back face. The print liquid supply also includes a spout affixed to the reservoir. The spout is located at a corner of the front face offset from a centerline of the front face.

15 Claims, 27 Drawing Sheets

(56) References Cited

U.S. PATENT DOCUMENTS

| | | | |
|---|---|---|---|
| 6,010,210 | A | 1/2000 | Wilson et al. |
| 6,120,132 | A | 9/2000 | Coiner et al. |
| 6,228,011 | B1 | 5/2001 | Takemura et al. |
| 6,612,466 | B1 | 9/2003 | Malin |
| 6,746,419 | B1 | 6/2004 | Arnett et al. |
| 6,849,462 | B1 | 2/2005 | Winkler et al. |
| 7,287,843 | B2 | 10/2007 | Muranaka et al. |
| 7,334,889 | B2 | 2/2008 | Sasaki et al. |
| 7,429,101 | B2 | 9/2008 | Petersen et al. |
| 8,220,909 | B2 | 7/2012 | Domae |
| 8,448,799 | B2 | 5/2013 | Thurman et al. |
| 8,474,655 | B2 | 7/2013 | Hackleman et al. |
| 8,479,785 | B2 | 7/2013 | Johnson |
| 8,480,220 | B2 | 7/2013 | Mizuno et al. |
| 8,789,935 | B2 | 7/2014 | Murata |
| 9,114,621 | B2 | 8/2015 | Shimizu et al. |
| 9,248,655 | B2 | 2/2016 | Nose |
| 9,527,295 | B1 | 12/2016 | Tamarez et al. |
| 9,573,736 | B2 | 2/2017 | Arch et al. |
| 9,623,664 | B2 | 4/2017 | Maeshima |
| 2002/0171713 | A1 | 11/2002 | Ueno et al. |
| 2004/0218021 | A1 | 11/2004 | Ishizawa et al. |
| 2004/0263569 | A1 | 12/2004 | Ros et al. |
| 2005/0184105 | A1 | 8/2005 | Johnson |
| 2006/0038864 | A1 | 2/2006 | Konishi et al. |
| 2006/0152561 | A1 | 7/2006 | Belfiore et al. |
| 2006/0233921 | A1 | 10/2006 | Mock et al. |
| 2008/0057573 | A1 | 3/2008 | Hutchins et al. |
| 2008/0267538 | A1 | 10/2008 | Stephenson |
| 2009/0096836 | A1 | 4/2009 | Haines et al. |
| 2012/0162326 | A1 | 6/2012 | Kobayashi et al. |
| 2012/0162329 | A1 | 6/2012 | Mizuno et al. |
| 2013/0215201 | A1 | 8/2013 | Murata |
| 2014/0332492 | A1 | 11/2014 | Seki et al. |
| 2014/0353364 | A1 | 12/2014 | Coogan et al. |
| 2015/0028065 | A1 | 1/2015 | Arch et al. |
| 2015/0232264 | A1 | 8/2015 | Pansegrouw |
| 2015/0280650 | A1 | 10/2015 | Brown et al. |
| 2015/0290945 | A1 | 10/2015 | Naito et al. |
| 2016/0303863 | A1 | 10/2016 | Sakai |
| 2017/0081060 | A1 | 3/2017 | Van et al. |
| 2018/0043695 | A1 | 2/2018 | Kawate et al. |

FOREIGN PATENT DOCUMENTS

| | | | |
|---|---|---|---|
| CN | 1928402 | A | 3/2007 |
| CN | 101024343 | A | 8/2007 |
| CN | 101189173 | A | 5/2008 |
| CN | 101254708 | A | 9/2008 |
| CN | 101675210 | A | 3/2010 |
| CN | 102026889 | A | 4/2011 |
| CN | 102333980 | A | 1/2012 |
| CN | 103459268 | A | 12/2013 |
| CN | 203322492 | U | 12/2013 |
| CN | 104864140 | A | 8/2015 |
| CN | 204566929 | U | 8/2015 |
| CN | 105383167 | A | 3/2016 |
| DE | 102006054113 | B3 | 1/2008 |
| EP | 0516088 | A2 | 12/1992 |
| EP | 0854045 | A2 | 7/1998 |
| EP | 1201437 | A1 | 5/2002 |
| EP | 1504908 | A2 | 2/2005 |
| EP | 1629982 | A2 | 3/2006 |
| EP | 1806296 | A1 | 7/2007 |
| EP | 1817241 | A2 | 8/2007 |
| EP | 2783861 | A2 | 10/2014 |
| JP | 04-347653 | A | 12/1992 |
| JP | 05-162333 | A | 6/1993 |
| JP | 10-157770 | A | 6/1998 |
| JP | 2002-019136 | A | 1/2002 |
| JP | 2004-189276 | A | 7/2004 |
| JP | 2009-298444 | A | 12/2009 |
| JP | 2010-158906 | A | 7/2010 |
| JP | 2012-058343 | A | 3/2012 |
| JP | 4973758 | B2 | 7/2012 |
| JP | 2012-158343 | A | 8/2012 |
| JP | 5200677 | B2 | 6/2013 |
| JP | 5513420 | B2 | 6/2014 |
| JP | 2017-164955 | A | 9/2017 |
| KR | 10-2016-0002716 | A | 1/2016 |
| KR | 20-2016-0002716 | U | 8/2016 |
| WO | 97/42035 | A1 | 11/1997 |
| WO | 2006/019034 | A1 | 2/2006 |
| WO | 2006/051284 | A2 | 5/2006 |
| WO | 2009/139761 | A1 | 11/2009 |
| WO | 2017/014779 | A1 | 1/2017 |
| WO | 2017/213162 | A1 | 12/2017 |

OTHER PUBLICATIONS

"Type 2 Button-fix," (Button-fix), retrieved at https://button-fix.com/products/type-2, retrieved on Mar. 23, 2022, 1 page.

"Ultima Pod Box Brackets," (Ultima), retrieved at https://www.comtecdirect.co.uk/product/ultima-pod-box-brackets/PG0149/778434, retrieved on Mar. 23, 2022, 1 page.

PLIABLE PRINT LIQUID SUPPLY RESERVOIRS WITH OFFSET SPOUT

BACKGROUND

Printing devices operate to dispense a liquid onto a surface of a substrate. In some examples, these printing devices may include two-dimensional (2D) and three-dimensional (3D) printing devices. In the context of a 2D printing device, a liquid such as an ink may be deposited onto the surface of the substrate. In the context of a 3D printing device, an additive manufacturing liquid may be dispensed onto the surface of the substrate in order to build up a 3D object during an additive manufacturing process. In these examples, the print liquid is supplied to such printing devices from a reservoir or other supply. The print liquid reservoir holds a volume of print liquid that is passed to a liquid deposition device and ultimately deposited on a surface.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
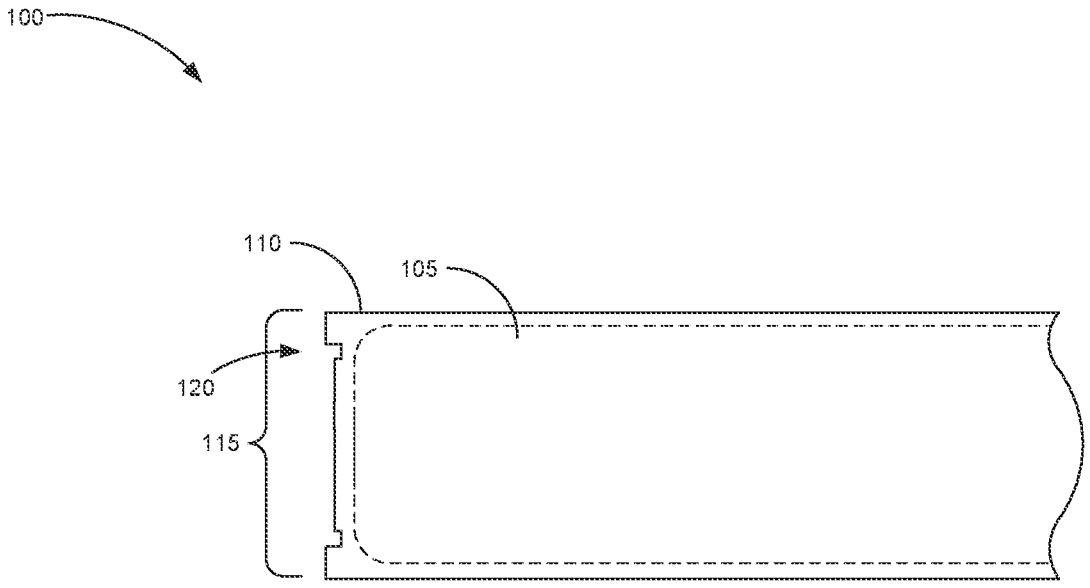
FIG. 1 is a bottom view diagrammatic drawing of a liquid supply according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Liquids such as printing liquids in a printing device and/or an additive manufacturing liquid in 3D printing devices are supplied to a deposition device from liquid supplies. Such liquid supplies come in many forms. For example, one such liquid supply includes a pliable reservoir. Pliable reservoirs are simple to form and are low cost. However, pliable reservoirs themselves are difficult to handle and couple to an ejection device. For example, it may be difficult for a user to physically manipulate a pliable reservoir into place within a printing device due to a lack of rigid structure around the pliable reservoir.

The pliable reservoirs may be disposed in a container, carton, box, or other similar structure. The container provides a structure that is relatively easier to be handled by a user. That is, a user can more easily handle a rigid container than a pliable reservoir alone. As a specific example, over the course of time, the liquid in a liquid supply is depleted such that the liquid supply is to be replaced by a new supply. Accordingly, ease of handling makes the replacement of liquid supplies more facile and leads to a more satisfactory consumer experience. Pliable containment reservoirs disposed within a rigid container may be, in some examples, referred to as bag-in-box supplies or bag-in-box liquid supplies. Such bag-in-box supplies thus provide easy handling along with simple and cost-effective manufacturing.

Certain features may further increase bag-in-box supply utility and efficacy. For example, in order to impart proper functionality of a printing device, a liquid-tight path is to be established between the reservoir and the printing device. To establish such a path, there should be alignment between the reservoir and the ejection device components that receive the liquid from the reservoir. Due to the flimsy nature of pliable reservoirs, it may be difficult to ensure a proper alignment between the reservoir and the ejection device.

Accordingly, the present specification describes a print liquid reservoir and bag-in-box print liquid supply that creates a structurally rigid interface between a spout of the containment reservoir and an ejection system. That is, the present system locates, and secures, a spout of the reservoir in a predetermined location. Being thus secured, the spout through which print liquid passes from the containment reservoir to the ejection device should not rotate, flex or translate relative to the rigid container, but will remain stationary relative to the container. Affixing the spout in this fashion ensures that the spout will remain solid through installation and use.

The present specification describes bag-in-box supplies that include a pre-positioned, secured dispensing spout. In some examples, the bag-in-box supplies include a reservoir having an integrated dispensing spout, a container in which the reservoir is disposed and a clamp plate assembly that securely supports the spout in a desired location within the container. In some examples, the bag-in-box supplies may include a cap fluidically coupled to the reservoir and coupled to the spout. In some examples the cap continues the fluidic path between the reservoir/spout and the printing device. In some examples the cap may provide additional support to the bag-in-box supplies when coupled with the spout and clamp plate.

Specifically, a print liquid supply includes a reservoir for holding a supply of print liquid. The reservoir includes a pliable body having a front face and a back face. The print liquid supply also includes a spout affixed to the reservoir. The spout is located at a corner of the front face offset from a centerline of the front face.

In any example, the reservoir holds at least 100 milliliters of liquid. Still further, in any example, 1) the reservoir may have different volume capacities, for example of approximately 100 millimeters, 250 milliliters, 500 millimeters, or 1000 milliliters, and 2) the spout is located at a pre-defined offset distance from a respective edge of an empty reservoir independent of the volume of the reservoir.

Even further, in any example the reservoir is at least 145 millimeters tall in an empty state. In any example, the front face is directly affixed to the back face. In any example, the corner is adjacent to an opening of a container in which the reservoir is inserted. Further, in any example, the corner is a corner that is adjacent to a bottom of a container in which the reservoir is inserted.

In any example, the spout is at least 15 millimeters from a top edge of the reservoir and/or the spout is at least 15 millimeters from a side edge of the reservoir. In any example, the spout is offset is more than 0 millimeters and 60 millimeters or less from a centerline of the reservoir.

In any example, the spout includes 1) a sleeve having an opening through which print liquid passes, 2) a first flange extending outward from the sleeve to affix the spout to the reservoir, 3) a second flange extending outward from the sleeve to sit on a wall of the container in which the reservoir is disposed, and 4) an angled clamp flange having an angled surface and a straight surface opposite the angled surface. The angled clamp flange affixes the spout to the container.

In any example, the supply further includes a clamp plate assembly. The clamp plate assembly includes a clamp that includes two wedge-shaped forked ends to facilitate clamping the spout to a container in which the reservoir is disposed and a slot defined by the forked ends to receive and retain the spout. The clamp plate assembly also includes a back plate orthogonal to the clamp plate against which a user pushes to engage the wedge-shaped forked ends with an angled clamp flange of the spout.

The present specification also describes a bag-in-box print liquid supply. The bag-in-box supply includes a pliable reservoir for holding a supply of print liquid. The reservoir includes a pliable body having a front face and a back face. The bag-in-box supply also includes a container in which the reservoir is at least partially disposed and a spout. The spout is located at a corner of the front face and offset from a centerline of the front face.

In any example, a front surface of the container has an aspect ratio of at least 1.1. Further, in any example the container includes an alignment slot to position the spout at a predetermined location during insertion of the pliable reservoir. In any example, the supply of print liquid is an additive manufacturing fabrication agent. In any example, the container is constructed of corrugated fiberboard.

The present specification also describes a plurality of print liquid supplies. Each print liquid supply includes a reservoir for holding a supply of print liquid. The reservoir includes 1) a flat pliable body when empty, 2) a front face and a back face, and 3) a liquid transfer-inhibiting material. Each supply also includes a spout affixed to the reservoir. The spout 1) is located at a corner of the front face of the reservoir when empty, adjacent to an opening of a container in which the reservoir is inserted, 2) includes a sleeve extending through the reservoir, and 3) is located closer to a first wall of the reservoir than a second wall of the reservoir which is opposite to the first wall.

In any example, 1) each reservoir holds a different volume of liquid, 2) each reservoir has a different distance between the first wall and the second wall, and 3) spouts of the different reservoirs are located a same distance from the corresponding first walls as compared to other spouts.

In any example, 1) each reservoir holds a different volume of liquid, 2) each reservoir has a different distance between the first wall and the second wall, and 3) spouts of the different reservoirs are located a same distance from the corresponding corner as compared to other spouts.

In any example, the print liquid is ink and/or the reservoirs are rectangular when empty.

In summary, such a spout 1) is rigidly coupled to a print liquid reservoir; 2) facilitates a non-rotating, non-translating spout relative to a container in which the reservoir is disposed; 3) promotes a simple installation of a print liquid supply into a liquid ejection system; and 4) is easily manufactured with a small number of parts and few operations.

As used in the present specification and in the appended claims, the term "print liquid supply" refers to a device that holds a print liquid. For example, the print liquid supply may include a pliable reservoir. Accordingly, a "print liquid supply container" refers to a carton or other housing for the print liquid supply. For example, the print liquid supply container may be a cardboard box in which the pliable reservoir is disposed.

Still further, as used in the present specification and in the appended claims, the term "print liquid" refers to any type of liquid deposited by a printing device and can include, for example, printing ink or an additive manufacturing fabrication agent. Still further, as used in the present specification and in the appended claims, the term "fabrication agent" refers to any number of agents that are deposited and includes for example a fusing agent, an inhibitor agent, a binding agent, a coloring agent, and/or a material delivery agent. A material delivery agent revers to a liquid carrier that includes suspended particles of at least one material used in the additive manufacturing process.

Turning now to the figures, FIG. 1 is a bottom diagrammatic drawing of a liquid supply (100) according to an example of the principles described herein. In any of the examples described herein, liquid supply (100) may include a bag (105). In any of the examples described herein, the liquid supply (100) may include a box (110) to maintain the bag (105) therein.

The bag (105) may be any type of pliable container that can maintain an amount of liquid therein. The liquid maintained in the bag (105), in any of the examples described herein, may be a printing liquid such as ink for a 2D printing device or an additive manufacturing material for a 3D printing device. The bag (105) may prevent liquid, both gases and liquids, from exiting or entering therein. In an example, the bag (105) may comprise a number of layers of material that is both pliable and impermeable to liquid. The impermeability of the bag (105) prevents the liquid therein from being altered chemically by any introduction of another liquid exterior to the bag (105). In some examples, the bag (105) may be gas impermeable as well to prevent gases from entering and exiting the bag (105). For example, the impermeability of the bag (105) may prevent the liquid from drying out, which can cause the fluid to thicken thereby resulting in a different color tone printed by the printing device using the fluid. Further, the impermeability of the bag (105) may prevent air from entering. Air that enters may lead to excessive air buildup in the bag (105), which pay pass, over time, into the remaining parts of the systems described herein.

In any of the examples described herein, the bag (105) may include a spout. The spout may extend from the bag (105) at any location on the surface of the bag (105). The spout may include a first flange that couples the spout to the bag (105).

In any of the examples described herein, the box (110) may include a number of walls that form a cuboid shape. In any of the examples described herein, the box (110) may be made of a material that imparts structural support to the bag (105) to be maintained therein. Examples of materials that may be used to form the box (110) may include a fiberboard material. In an example, the box (110) may be made of a corrugated fiberboard material. In an example, the corrugated fiberboard material may be an f-fluted corrugated fiberboard material. Although, the present specification describes the box (110) as being made of a corrugated fiberboard material, the present specification contemplates that the material used to form the box (110) may include other fiberboards such as an uncorrugated fiberboard, another polymer, a metal, a plastic or other material. In an example, the box (110) may be formed from a single sheet of fiberboard material. In this example, the fiberboard material may be shaped by creating creases therein that produce fold locations. The box (110), in this example, may then be folded such that the six walls of the cuboid shape may be formed. In an example, the box (110) may include a number of flaps that overlap at least one wall. The flap may be secured to a wall via an adhesive material.

Along an edge (115) of at least one wall of the box (110), a number of alignment structures (120) may be formed. The alignment structures (120) formed on the edge (115) of one of the number of walls allows the box (110) to be interfaced with a support element described herein. The support element, along with the box (110), may be used to support the bag (105) within and against a surface of the box (110).

In any of the examples described herein, the box (110) may include a tab extending from a wall of the box. In an example, the tab may extend from a flap described herein. The tab, in any of the examples described herein, may interface with a recess defined in a cap fluidically coupled to the bag (105). The recess in the cap may conform to the shape of the tab so as to help align at least the tab with the recess during manufacture. In any of the examples described herein, alignment of the tab with the recess on the cap may indicate proper folding of the box (110) such that the box (110) forms a generally cuboid in shape.

In any of the examples described herein, the box (110) may further include a channel formed into one of the walls of the box (110) from an edge (115) of that wall. In any of the examples described herein, the channel may be formed in the wall of the box (110) on the wall where the alignment structures (120) are formed. The channel may be formed into the wall in order to receive a spout formed on the bag (105). The spout, in any of the examples described herein, may be used to convey a liquid from the bag (105) to the cap as described herein.

Figure 2:
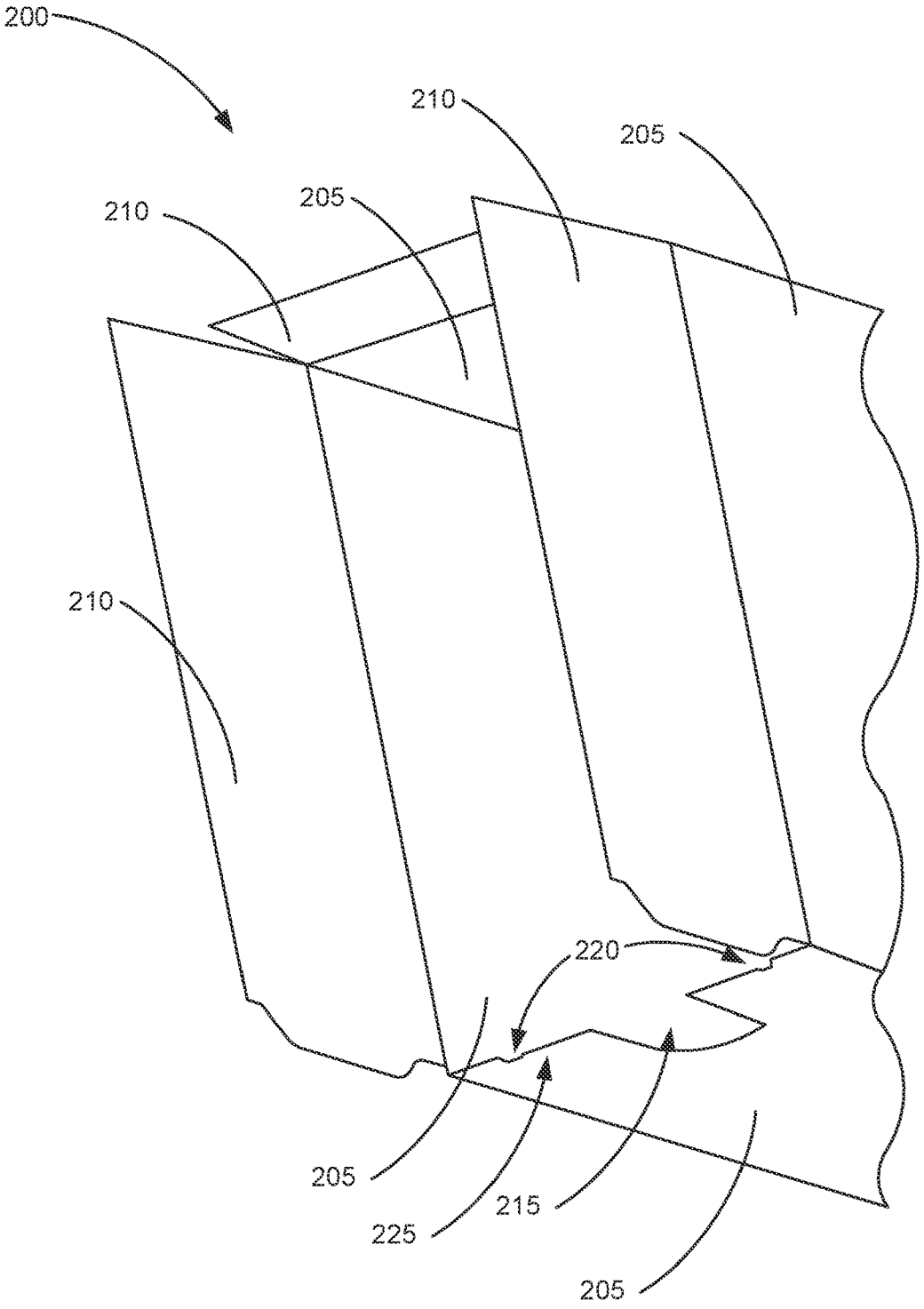
FIG. 2 is an isometric partial view of a carton fold structure for a print liquid supply according to an example of the principles described herein.

FIG. 2 is an isometric partial view of a carton fold structure (200) for a print liquid supply according to an example of the principles described herein. The carton fold structure (200) may include a number of planes (205) formed into a cuboid shape. The planes (205) may, together, form a cuboid shape, each plane (205) to form an outer wall of the carton fold structure (200). Between two of the number of the planes (205), an edge of the carton fold structure (200) may be formed.

In any of the examples described herein, a plane (205) of the number of planes of the carton fold structure (200) may be formed by a number of flaps (210). The number of flaps (210) may be used to form a wall of the carton fold structure (200) when coupled together via, for example, an adhesive. In any of the examples described herein, the flaps (210) may include a number of voids through which the adhesive may pass to any of the flaps (210) under any of the flaps (210). In an example, the adhesive may also couple the flaps (210) to the support structure described herein.

The carton fold structure (200) may, in any of the examples described herein, include a channel (215) extending inwards into a first plane (205) to allow a spout to pass through the first plane (205). The channel (215) may extend any distance into the first plane (205) and the placement of the channel (215) may be dependent on the placement of the spout.

In any of the examples described herein, the carton fold structure (200) may further include slots (220) extending into the first plane (205) between the channel (215) and an edge associated with the first plane (205). In any of the examples described herein, the slots (220) may be used to align the carton fold structure (200) to a support element during manufacture.

In any of the examples described herein, the carton fold structure (200) may hold or otherwise maintain a liquid bag. The liquid bag may maintain any amount of liquid. In an example, the liquid bag may have a maximum liquid fill capacity of at least approximately 100 milliliters, at least approximately 200 milliliters, at least approximately 400 milliliters, at least approximately 500 milliliters, at least approximately 750 milliliters, or at least approximately 1 L. The liquid bag may have a spout that, as described herein, fits into the channel (215). The spout may interface with a liquid bag interface fluidically coupled to the liquid bag via the spout. In any of the examples described herein, the liquid bag may provide the liquid a printing device.

In any of the examples described herein, any of the planes (205) and or flaps (210) may include a tab as described herein. The tab may interface with a recess defined in the liquid bag interface fluidically coupled to the liquid bag via the spout.

In any of the examples described herein, the carton fold structure (200) includes a shallow end (225) formed into an edge associated with the first plane (205) of the carton fold structure (200) to place the support element flush with an edge of the first plane (205) of the carton fold structure (200). The shallow end (225) allows for the support element to be placed flush with an edge of the first plane (205) so that, in an example, the flaps (210) may be closed against the support member during assembly of the carton fold structure (200).

The carton fold structure (200) may, in any of the examples described herein, include a number of voids defined in the second plane of the carton fold structure (200). The voids may provide a conduit through which an adhesive may be deposited to affix the second plane to the support element.

Figure 3:
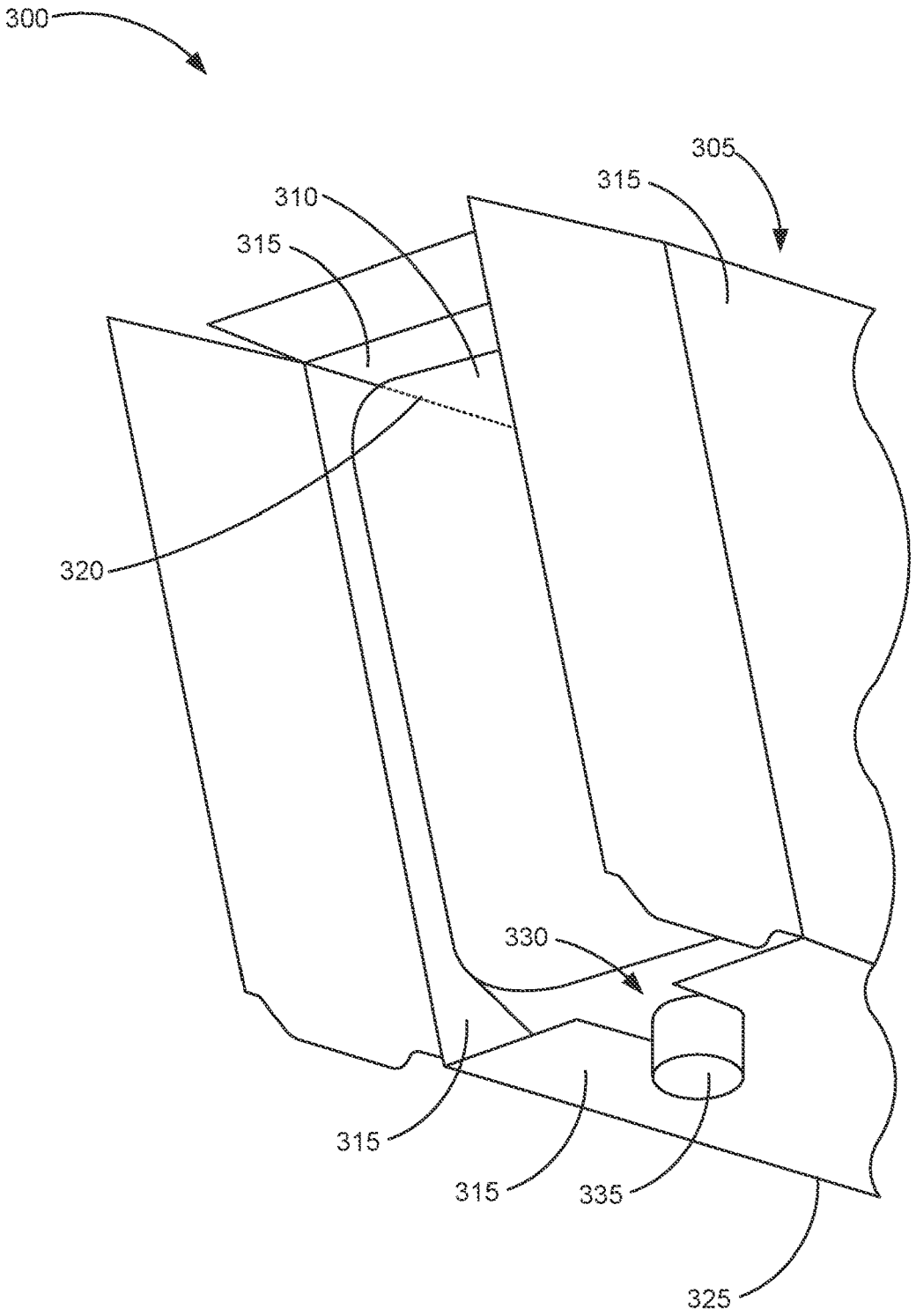
FIG. 3 is an isometric view of an assembly of printing device liquid supply component according to an example of the principles described herein.

FIG. 3 is an isometric view of an assembly (300) of printing device liquid supply components according to an example of the principles described herein. The assembly (300) may include a box structure (305). The box structure (305) may be made of a cellulose-based material for a print liquid supply. In any of the examples described herein, the assembly (300) may further include a liquid impermeable liquid bag (310). The liquid impermeable liquid bag (310) may maintain an amount of liquid therein include, for example, a printing liquid.

In any of the examples described herein, the box structure (305) may include a plurality of walls (315) forming a cuboid shape. As described herein, the walls (315) may be formed to fit any size of liquid impermeable liquid bag (310). Each of the walls (315) may be folded along a fold line (320) to form and edge (325) of the cuboid shape. In any of the examples described herein, some edges (325) may not interface with any of two of the planes (315).

In any of the examples described herein, the box structure (305) may include a cut out (330) in a first wall (315). In any of the examples described herein, the cut out (330) may allow a liquid output (335) fluidically connected to the liquid impermeable liquid bag (310) to pass through the box structure (305). In any of the examples described herein, the cut out (330) extends into the first wall from an edge of the first wall. In any of the examples described herein, the cut out (330) extends from a first edge of the first wall towards a second edge opposite the first edge but not reaching a middle between the first and second edges.

In any of the examples described herein, the cut out (330) includes slots cut into the first wall extending from a first edge of the first wall towards a second edge of the first wall. These slots may be used to align a support element with the box structure (305).

In any of the examples described herein, the cuboid shape of the box structure (305) may have a height, a width, and a length. In any example, the height and length are greater than the width.

In any of the examples described herein, the box structure (305) includes a shallow end formed into the edge of the first wall to place a support element flush with a terminal end of the edge of the first wall. The support structure, along with the box structure (305), may impart a rigidity to the assembly (300) rendering use of the assembly (300) relatively more facile than the liquid impermeable liquid bag (310) alone.

Figure 4:
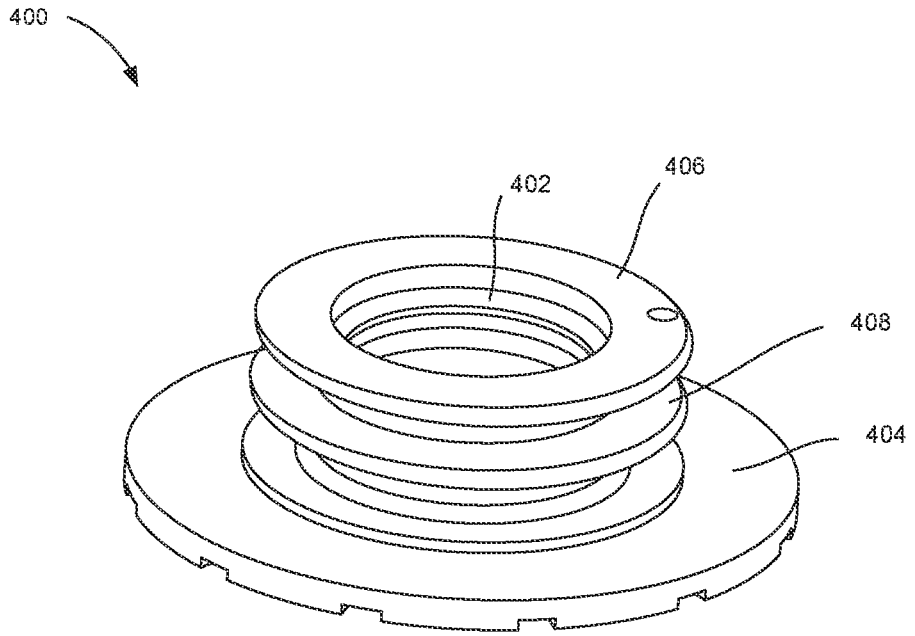
FIG. 4 is an isometric view of a spout with an angled clamp flange for a print liquid supply according to an example of the principles described herein.

FIG. 4 is an isometric view of a spout (400) with an angled clamp flange (408) for a print liquid supply, according to an example of the principles described herein. The spout (400) enables print liquid disposed within a reservoir, such as the liquid impermeable liquid bag (FIG. 3, 310), to be passed to an ejection device for deposition on a surface. The spout (400) may be formed of any material such as a polymeric material. In a specific example, the spout (400) is formed of polyethylene.

The spout (400) includes various features to ensure accurate and effective liquid transportation. Specifically, the spout (400) includes a sleeve (402) having an opening through which the print liquid passes. The sleeve (402) is sized to couple with a component of a liquid ejection device. For example, the sleeve (102) may be coupled to a receiver port within a printing device. Once coupled, liquid within the reservoir is drawn/passes through the sleeve (102) to the ejection device. That is, during operation forces within the ejection device draw liquid from the reservoir, through the sleeve (102) and into the ejection device. The ejection device then operates to expel the liquid onto a surface in a desired pattern.

The sleeve (402) may be cylindrical and formed of a rigid material, such as a rigid plastic, to facilitate secure coupling to the receiver port. The sleeve (402) may have an inside diameter of between 5 millimeters to 20 millimeters. For example, the sleeve (402) may have an inside diameter of between 10 millimeters and 15 millimeters. As a further example, the sleeve (402) may have an inside diameter of between 11.5 millimeters and 12.5 millimeters.

The spout (400) also includes a first flange (404). The first flange (404) extends outward from the sleeve (402) and affixes the spout (400) to the reservoir. For example, the reservoir may, in an empty state, include a front face and a back face. The front face may have a hole that is sized to allow a second flange (406) and the angled clamp flange (408) to pass through, but not the first flange (404). That is, the first flange (404) may have a diameter that is greater than a diameter of both the angled clamp flange (408) and the second flange (406).

Accordingly, in use, the first flange (404) may be disposed on one side, an interior side, of the front face and the second flange (406) and the angled clamp flange (408) may be disposed on the other side, an exterior side, of the front face. Heat and/or pressure may then be applied to the spout (400) and reservoir such that the first flange (404) material composition and/or the reservoir material composition alters and the spout (400) and reservoir are permanently affixed to one another. In this fashion, the first flange (402) affixes the spout (400) to the reservoir.

The spout (400) also includes a second flange (406). The second flange (406) similarly extends outward from the sleeve (402). The second flange (406) affixes the spout (400) and corresponding reservoir to the container or box in which they are disposed. That is, during use, it is desirable that the spout (400) remains in one position and does not move from that position. Were the spout (400) to move, this might affect the liquid delivery. For example, if the spout (400) were to translate, it may not line up with the interface on an ejection device such that liquid would not be delivered as desired to the ejection device or may not be delivered at all. Moreover, such a misalignment could result in liquid leak and/or damage to components of the ejection device or the liquid supply. Accordingly, the second flange (406), along with the angled clamp flange (408) operate to locate the spout (400) in a predetermined position without movement relative to a container.

More specifically, when installed, the second flange (406) sits on a wall of the container or box in which the reservoir is disposed. A clamp plate and a surface of the print liquid supply container are disposed and squeezed, between the second flange (406) and the angled clamp flange (408). The force between the second flange (406) and the container secures the spout (400) in place relative to the container. As the container is rigid, the spout (400) therefore is rigidly located as well. FIGS. 18A-19E depict the installation and location of the spout (400).

Figure 5:
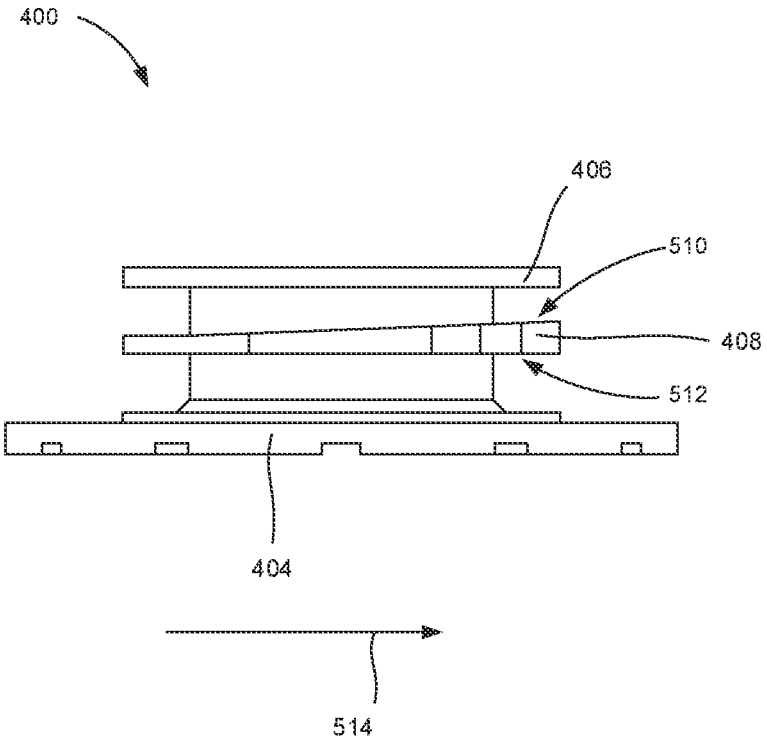
FIG. 5 is a side view of the spout with an angled clamp flange for a print liquid supply according to an example of the principles described herein.

The spout (400) also includes an angled clamp flange (408). As described above, the angled clamp flange (408), along with the second flange (406) securely affix the spout (402), and the reservoir to which it is attached, to the container such that it does not move relative to the container. Any relative movement between the container and the spout (402) may compromise the liquid path between the reservoir and the ejection device thus resulting in ineffective liquid delivery, liquid leaks, and/or component damage. FIG. 5 further depicts the operation of the angled clamp flange (408).

Specifically, FIG. 5 is a side view of the spout (400) with the angled clamp flange (408) for a print liquid supply depicted in FIG. 1, according to an example of the principles described herein. As depicted in FIG. 5, the angled clamp flange (408) has 1) an angled surface (510) and 2) a straight surface (512) that is opposite the angled surface (510). While FIG. 5 depicts element (512) as a surface parallel to the first flange (404) and the second flange (406), in some examples, element (512) may be parallel with the angled surface (510). In yet more examples, element (512) may be non-parallel to the first flange (404), the second flange (406), and/or the angled surface (510).

In some examples, the angled surface (510) has an angle of between 0.5 and 10 degrees relative to the straight surface (512). More specifically, the angled surface (510) has an angle between 0.5 and 8 degrees relative to the straight surface (512). In yet another example, the angled surface (510) has an angle between 0.5 and 3 degrees relative to the straight surface. The angled clamp flange (408) width increases along an insertion direction, which insertion direction is indicated in FIG. 5 by the arrow (514). The angled surface (510) increasing along the insertion direction facilitates the clamping or affixing of the spout to a predetermined location relative to the container. Specifically, as described above, the second flange (406) is to sit on top of a wall of the container. Then a clamp plate is slid along the angled clamp flange (408), and the clamp plate and external surface of the container are compressed between the angled clamp flange (408) and the second flange (406). This compression provides a force that affixes the spout (400) and the associated reservoir to the container.

Accordingly, the spout (400) as described herein is held firmly in place in a position relative to the container, such that the container and the reservoir move as one. Being so disposed, a user can manipulate the container knowing that the spout (400) will remain in that particular position, thus allowing alignment of the spout (400) with a liquid delivery system of the ejection device. Were the spout (400) not held firmly in place, movement of the spout (400) during insertion of the container into the printing device may occur. Such movement affects the ability to establish a proper fluidic connection between the reservoir and the ejection device. In other words, the spout as described herein allows for the use of a pliable reservoir which can hold large quantities of liquid, is easily manufacturable, and is impermeable to liquid and air transfer, all while being simple to insert into an ejection device.

Figure 6:
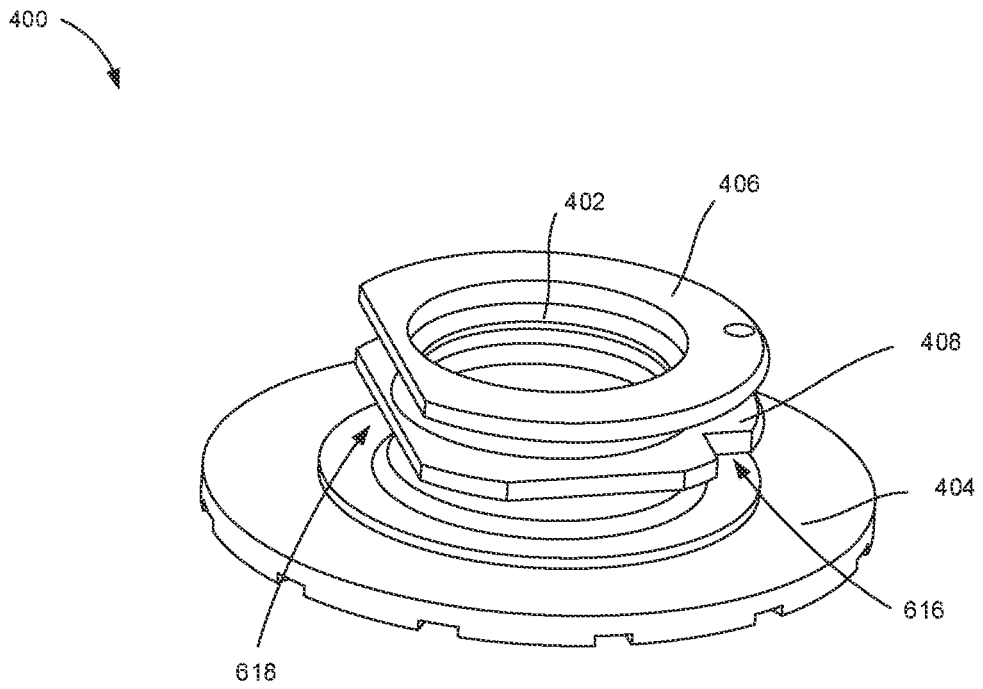
FIG. 6 is an isometric view of a spout with an angled clamp flange for a print liquid supply according to another example of the principles described herein.

In some examples, additional features of the spout (400) may be present. Accordingly, FIG. 6 is an isometric view of a spout (400) with an angled clamp flange (408) for a print liquid supply, according to another example of the principles described herein. Specifically, in this example, in addition to the sleeve (402), first flange (404), second flange (406), and angled clamp flange (408), this spout (400) includes at least one notch (616) in the angled clamp flange (408). The at least one notch (616) receives protrusions on the clamp plate and allows the clamp plate to rotate parallel with the second flange (406). That is, the clamp plate may initially be rotated relative to the spout (400) to allow the container to be positioned underneath the second flange (406). Such rotation allows for a large opening for the container to be slid into. That is, if the clamp plate were initially parallel to the second flange (406), there would be little space to insert the container wall, thus impacting the ease of assembly.

Once the sleeve (402) is properly aligned with the wall of the container, protrusions on the clamp plate fit into the notches (616) such that the clamp plate rotates to be parallel to, and adjacent with, the container. Following rotation, the angle of the angled clamp flange (408) forces a sliding clamp plate to compress the container wall against the second flange (406) thus providing the force to retain the spout (400) in place relative to the container. A specific example of the operation of the spout (400) and the clamp plate is provided in connection with FIGS. 18A-19E.

Figure 7:
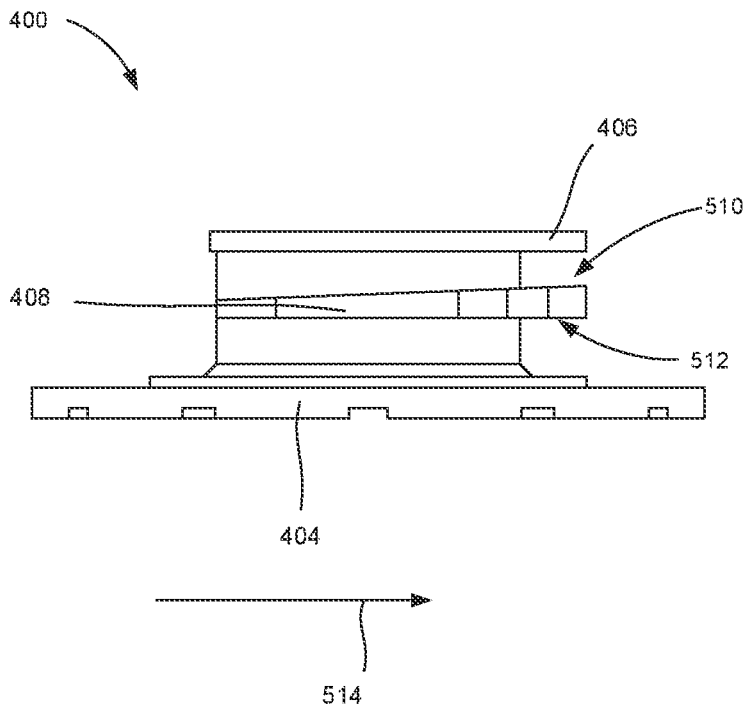
FIG. 7 is a side view of a spout with an angled clamp flange for a print liquid supply, according to an example of the principles described herein.

FIG. 7 is a side view of a spout (400) with an angled clamp flange (408) for a print liquid supply depicted in FIG. 6, according to an example of the principles described herein. In some examples, the spout (400) also includes an alignment mechanism to align the spout (400) to a predetermined radial position relative to the print liquid supply. That is, as mentioned above, the angled clamp flange (408) may increase in width along an insertion direction (514). Accordingly, the alignment mechanism may ensure that the spout (400) is aligned such that the angled clamp flange (408) increases in width along this insertion direction. That is, the alignment mechanism may ensure that the spout (400) is inserted into the reservoir such that the angled clamp flange (408) is aligned such that a thickest part of the angled clamp flange (408) is further along an insertion direction (514) than a thinner part of the angled clamp flange. Put yet another way, the alignment mechanism ensures that the spout (400) is aligned such that, upon insertion, the clamp plate first interacts with a thin part of the angled clamp flange (408) and later interacts with the thick part of the angled clamp flange (108).

In the specific example depicted in FIGS. 6 and 7, the alignment mechanism is a cutout (618) of at least one of the angled clamp flange (408) and the second flange (406). During insertion of the spout (400) into the reservoir, this cutout (618) may be aligned with a datum surface to ensure a proper alignment.

Figure 8:
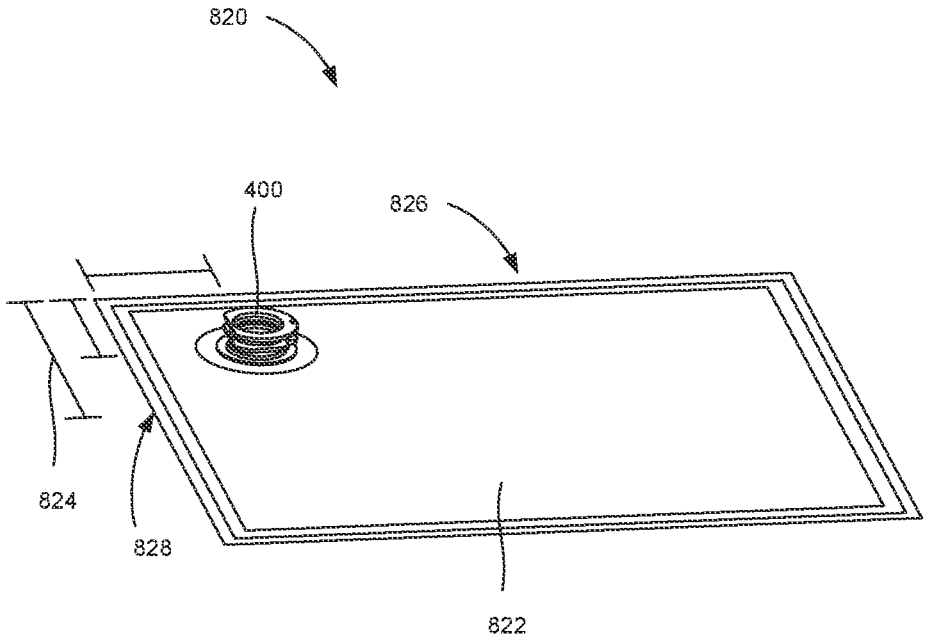
FIG. 8 is an isometric view of a pliable print liquid reservoir with an offset spout according to an example of the principles described herein.

FIG. 8 is an isometric view of a print liquid supply (820) that includes a spout (400) with an angled clamp flange (408), according to an example of the principles described herein. The print liquid supply (820) includes a pliable reservoir (822). In some examples, the reservoir (822) may be a collapsible reservoir (822). That is, the reservoir (822) may form to the contents disposed therein.

As described above, the reservoir (822) holds any type of liquid such as ink to be deposited on a 2D substrate or an additive manufacturing fabrication agent to be disposed on a 3D build material. For example, in an additive manufacturing process, a layer of build material may be formed in a build area. A fusing agent may be selectively distributed on the layer of build material in a pattern of a layer of a three-dimensional object. An energy source may temporarily apply energy to the layer of build material. The energy can be absorbed selectively into patterned areas formed by the fusing agent and blank areas that have no fusing agent, which leads to the components to selectively fuse together.

Additional layers may be formed and the operations described above may be performed for each layer to thereby generate a three-dimensional object. Sequentially layering and fusing portions of layers of build material on top of previous layers may facilitate generation of the three-dimensional object. The layer-by-layer formation of a three-dimensional object may be referred to as a layer-wise additive manufacturing process.

Figure 9:
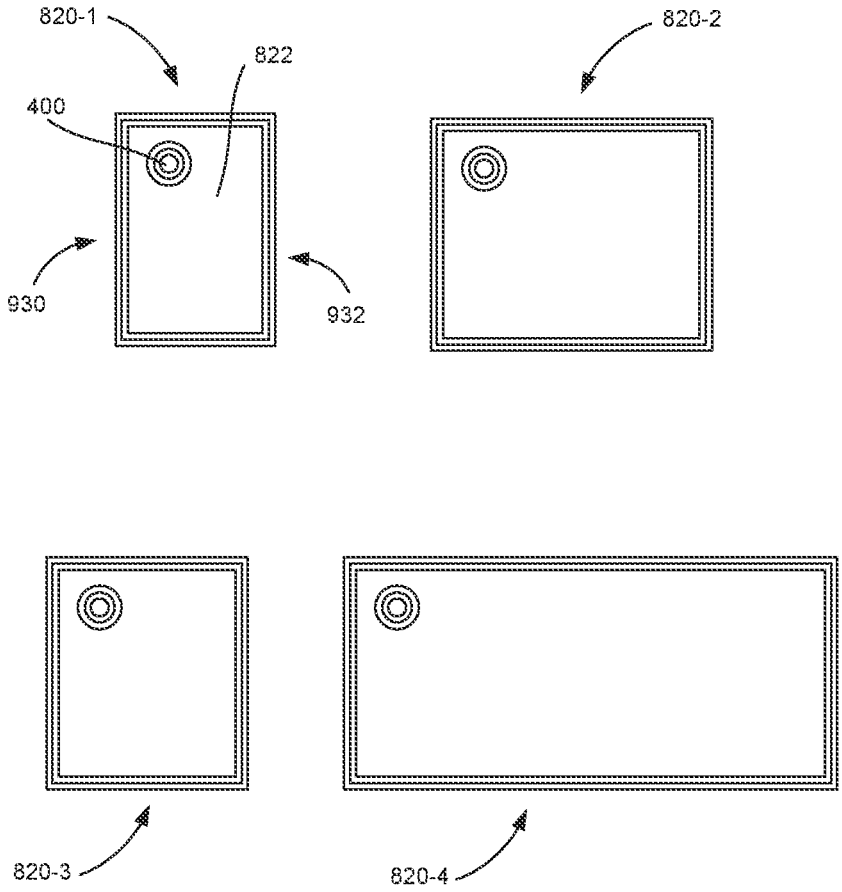
FIG. 9 is a plan view of a plurality of print liquid reservoirs with offset spouts according to an example of the principles described herein.

The reservoir (822) may be any size and may be defined by the amount of liquid which it can hold. For example, the reservoir (822) may hold at least 100 millimeters of liquid. While specific reference is made to a reservoir (822) holding a particular amount of liquid, the reservoir (822) may hold any volume of liquid. For example, as depicted in FIG. 9, different reservoirs (522) may hold 100, 250, 500, or 1,000 millimeters of liquid. In any of the examples presented herein, the reservoirs (522) may hold less than 100 ml. In any of these examples, the actual capacity of any of the reservoirs (522) may be greater than the amount of liquid maintained therein. As depicted in FIG. 8, in a generally empty state the reservoir (822) may have a rectangular shape. While FIG. 8 depicts the corners of the reservoir (822) as being right angles, in some cases the corners may be rounded.

To hold the liquid, the reservoir (822) may have any number of dimensions, for example, the reservoir may be at least 145 millimeters tall and in some particular examples may be at least 145 millimeters tall and may be 160 or less millimeters tall when the reservoir (822) is empty. Note that in the figures, references to relative positions such as top, bottom, side and dimensions such as height and width are for reference in the figures and are not meant to be indications of limiting the present description.

The reservoir (822) may be a dual-layer reservoir (822). In any example presented herein, the reservoir (822) may include a pliable front face and a pliable back face (not shown) when empty. The two may be directly joined together using a staking process. The reservoir (822) material is a liquid/air/vapor barrier to inhibit air entry or vapor exit. Specifically, the reservoir (822) may be formed out of a plastic film, a metallic film, or a combination thereof to inhibit air/vapor transfer. To have such properties, the front face and/or the back face may be formed of multiple layers, each layer being formed of a different material and having a different property.

FIG. 8 also clear depicts the spout (400) affixed to the reservoir (822) through which the print liquid passes. Specifically, the spout (400) may be affixed at a corner of the front face at an offset (824) from a centerline of the front face (820). As depicted in FIG. 8, the spout (400) may be asymmetrically positioned on the reservoir.

Specifically, the spout (400) may have an offset (824) that is more than 0 mm and 60 mm or less from a centerline of the reservoir (822). For example, the spout (400) may have an offset (824) of between 20-50 millimeters from a centerline of the reservoir (822). As another example, the spout (400) may have an offset (824) at least 48 millimeters from the centerline of the reservoir (822).

In some examples, the spout (400) extends between a center line and an edge of the empty reservoir, for example at a distance from the centerline of at least approximately a sixth, at least approximately a fourth, or at least approximately half of the distance between the center line and the edge.

In addition to having an offset (824) from a centerline of the reservoir (822), the spout (400) may have an offset from a top edge (826) of the reservoir (822) and may have an offset from a side edge (828) of the reservoir (822). Note that the directional indicators top, bottom, and side are used for explanatory purposes in the drawings and may change during operation. For example, the top edge (826) indicated in FIG. 8 may become the bottom edge as the reservoir (822) is inverted during use.

Returning to the offsets, the spout (400) may be offset between 15 and 50 millimeters from the top edge (826) of the reservoir (822) and in some examples may be offset between 25 and 35 millimeters from a top edge (826) of the reservoir (822). Similarly, the spout (400) may be offset between 15 and 50 millimeters from the side edge (828) of the reservoir (822) and in some examples may be offset between 25 and 35 millimeters from the side edge (828) of the reservoir (822).

FIG. 9 is a plan view of print liquid supplies (820-1, 820-2, 820-3, 820-4) having spouts (FIG. 4, 400) with angled flanges (FIG. 4, 408) according to an example of the principles described herein. As described above, each print liquid supply (820) includes a reservoir (822) that has a flat pliable body with a front face and a back face and that is formed of a liquid transfer-inhibiting material. Each liquid supply (820) also includes a spout (400) affixed to the reservoir (822). For simplicity in FIG. 8, the spout (400) and reservoir (822) for just one print liquid supply (820) are indicated with reference numbers.

Each reservoir (822) may include a first wall (930) which may be a wall closest to an insertion point of the reservoir (822) into a container. Each reservoir (822) also includes a second wall (932) which may be opposite the first wall (930) and which in some examples is a wall furthest from the insertion point of the reservoir (822) into the container. That is, when installed, the first wall (930) may be the wall of the reservoir (822) nearest the opening through which the reservoir (822) and its container were installed and the second wall (932) may be the wall of the reservoir (822) furthest from the opening through which the reservoir (822) is installed.

Figure 14:
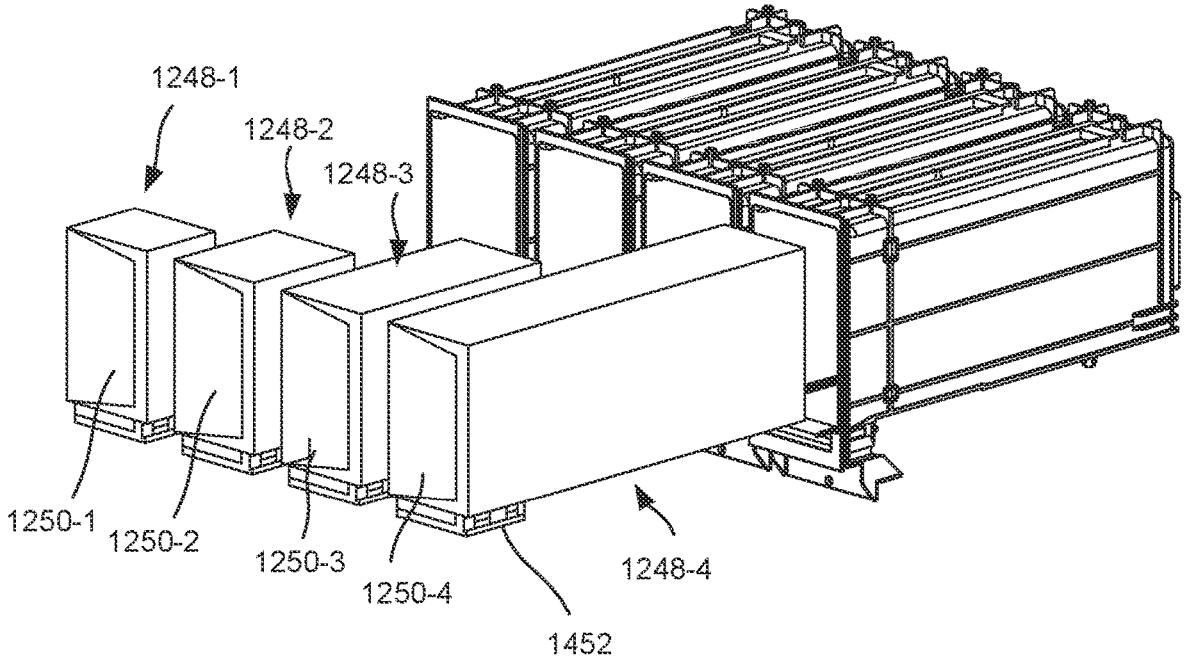
FIG. 14 is an isometric view of different bag-in-box print liquid supplies upon insertion into a printing device according to an example of the principles described herein.

As indicated in FIG. 9, for any size of reservoir (822) the spout (400) is located closer to the first wall (930) than the second wall (932). Moreover, in each case, regardless of the volume, the spout (400) is located the same distance away from the first wall (930). Put another way, each reservoir (822) may be suitable to hold a different volume of liquid, such as 100 ml, 250, ml, 500, ml and/or 1,000 ml, and may have a different distance between the first wall (930) and the second wall (932). However, spouts (400) of the different reservoirs (822) are located at a same distance, i.e., have a same offset, from the corresponding first wall (930) as compared to other reservoirs (822). Put yet another way, the spouts (400) of the different reservoirs (822) may be the same distance away from the respective corners. Moreover, each reservoir (822) may have the same height. That is, each reservoir (822) may have a different width, i.e., difference between first wall (930) and second wall (932) but may have a height of at least 145 millimeters and less than or equal to 160 millimeters tall. As each reservoir (822) has the same height, the corresponding face of a container will similarly be the same. That is, as depicted in FIG. 14, regardless of the size or width of a reservoir (822) and/or container, the front face, or insertion face of the container has the same dimension regardless of the volume of the supply.

Figure 10:
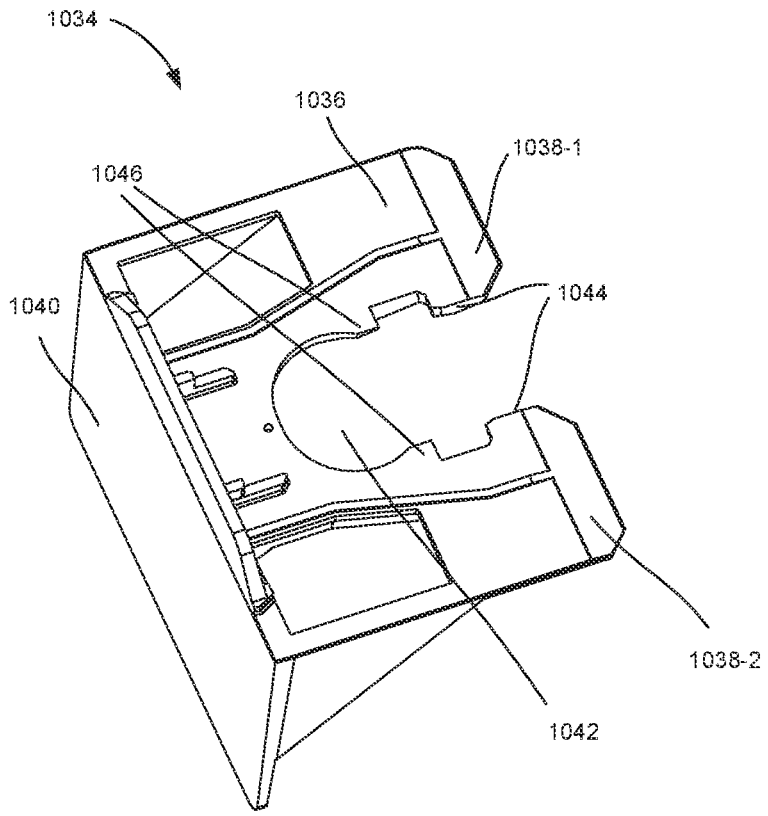
FIG. 10 is an isometric view of a supply container clamp plate assembly with wedge-shaped fork ends according to an example of the principles described herein.
Figure 11:
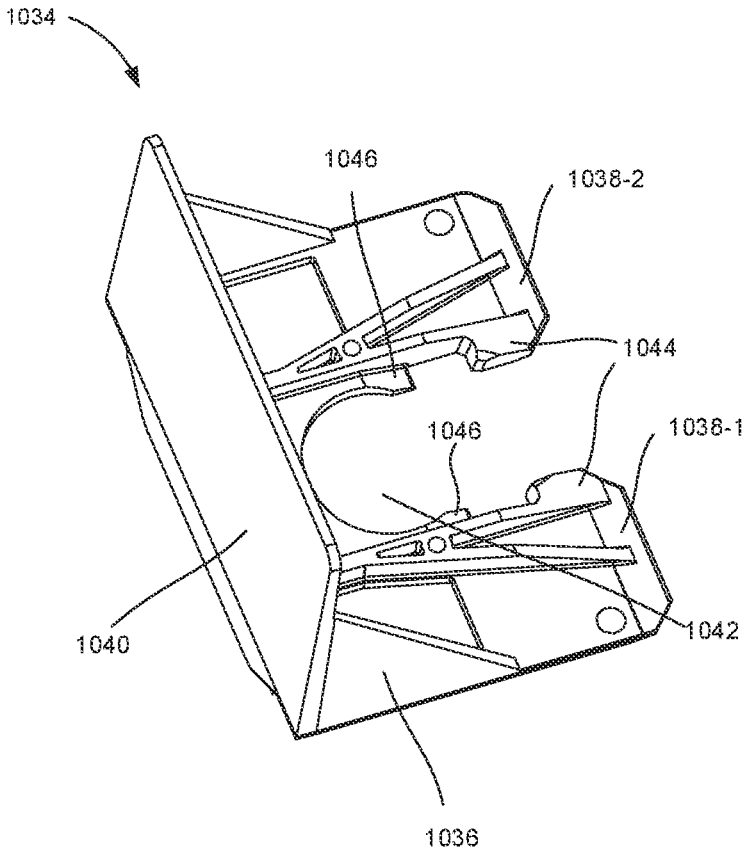
FIG. 11 is an isometric view of a supply container clamp plate assembly with wedge-shaped fork ends according to an example of the principles described herein.

FIGS. 10 and 11 are isometric views of a supply container clamp plate assembly (1034) with wedge-shaped ends (1038-1, 1038-2), according to an example of the principles described herein. The clamp plate assembly (1034) includes a clamp plate (1036) that interfaces with the spout (FIG. 4, 400) as detailed in FIGS. 18A-19E to secure the spout (FIG. 4, 400) and reservoir (FIG. 8, 822) firmly in a predetermined position such that the spout (FIG. 4, 400) can interface with a connection of the ejection device to deliver liquid to the ejection device. The clamp plate assembly (1034) also includes a back plate (1040) that is approximately orthogonal to the clamp plate (1036). Pushing the back plate (1040) engages the wedge-shaped forked ends (1038-1, 1038-2) of the clamp plate (1036) to engage the spout (FIG. 4, 400).

The clamp plate (1036) includes various components to facilitate such an interface with the spout (FIG. 4, 400). Specifically, the clamp plate (1036) includes a slot (1042) defined by two wedge-shaped forked ends (1038-1, 1038-2). The slot (1042) receives and retains the spout (FIG. 4, 100).

The forked ends (1038-1, 1038-2) may be wedge-shaped. Accordingly, during insertion, the angle of the wedge interfaces with the angle of the angled clamp plate (FIG. 4, 408) to affix the container against the second flange (FIG. 4, 408). The pressure between the container and the second flange (FIG. 4, 408) prevents the relative motion of these components such that a rigid interface is provided. The rigid interface ensures that the spout (FIG. 4, 400) does not move as the container is inserted into a printing device nor during operation. If the spout (FIG. 4, 400) were to move, then there would be difficulty in aligning the spout (FIG. 4, 400) with a corresponding liquid interconnect on the printing device. Uncertainty regarding whether the spout (FIG. 4, 400) is properly aligned with such a liquid interconnect is unacceptable as it may lead to less than desired performance, a lack of functionality altogether and/or damage to components.

In some examples, the clamp plate (1036) includes a number of sets of protrusions (1044, 1046) that interface with the spout (FIG. 4, 400) and particularly the angled clamp flange (FIG. 4, 408) during the insertion process. Specifically, during a first stage of insertion, a set of leading protrusions (1044) that protrude in from a leading portion of the slot (1042) align below the angled clamp flange (FIG. 4, 408) and a set of trailing protrusions (1046) that protrude in from a trailing portion of the slot (1042) align above the angled clamp flange (FIG. 4, 408). In other words, the clamp plate assembly (1034) is angled downward respective to the spout (FIG. 4, 400). Doing so provides a large alignment point for the insertion of the container wall. When the container has been positioned between the second flange (FIG. 4, 406) and the angled clamp flange (FIG. 4, 408), the clamp plate assembly (1034) is rotated such that the leading protrusions (1044) pass through the notches (FIG. 6, 616) of the of the angled clamp flange (FIG. 4, 408) such that the leading protrusions (1044) and the trailing protrusions (1046) are above the angled clamp flange (FIG. 4, 408). In this position, the wedge-shaped ends (1038) are prepared to slide along the angled surface (FIG. 5, 510) of the angled clamp flange (FIG. 4, 408) to squish the container and spout (FIG. 4, 400) together. As described above, FIGS. 18A-19E depict this operation.

The clamp plate depicted in FIGS. 10 and 11 may be formed of any material that does not deform in the face of the pressures exerted during insertion. For example, the clamp plate assembly (1034) may be formed out of a thermoplastic polyester material.

Figure 12:
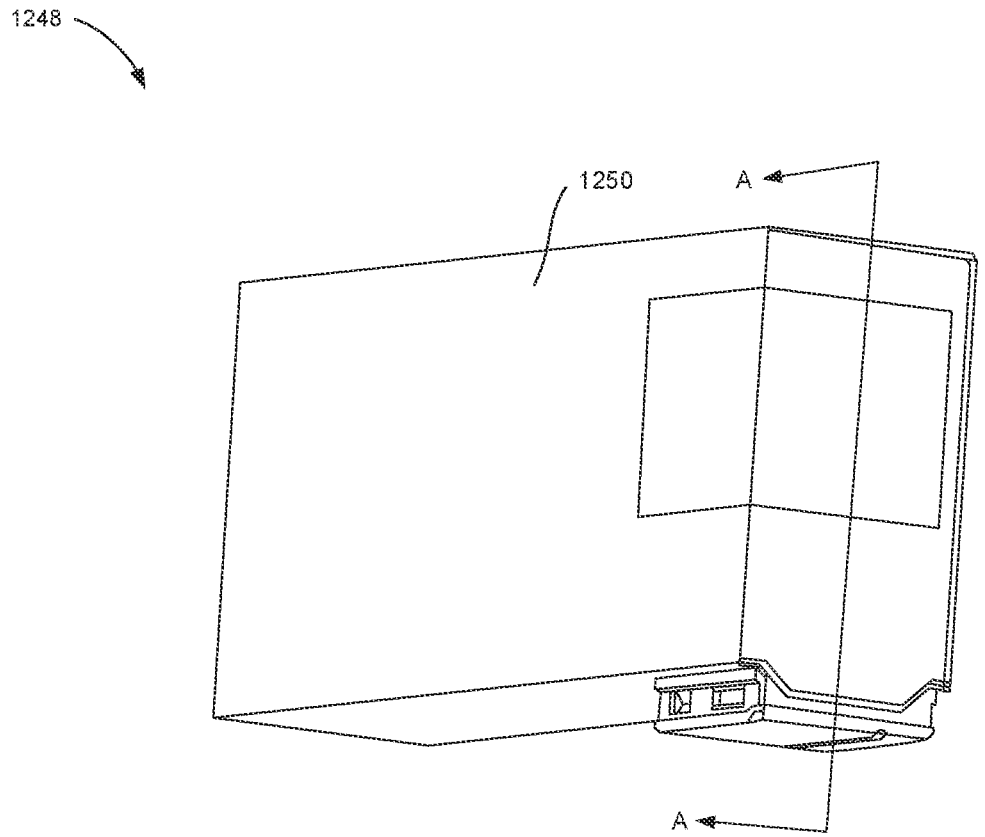
FIG. 12 is an isometric view of a bag-in-box print liquid supply according to an example of the principles described herein.

FIG. 12 is an isometric view of a bag-in-box print liquid supply (1248) according to an example of the principles described herein. As described above, the reservoir (FIG. 8, 822) may be disposed inside a container (1250). The container (1250) provides a rigid structure to be handled by a user during insertion. That is, while the reservoir (FIG. 8, 822) may be easy to manufacture it is difficult to handle and due to it's conforming to the shape of the contents therein. Moreover, it may be difficult to insert into, and couple to an ejection device. The container (1250) described herein provides structural strength such that the reservoir (FIG. 8, 822) can be used. The container (1250) may be formed of any material including corrugated fiberboard, which may be referred to as cardboard. The corrugated fiberboard container (1250) may be easy to manufacture and may provide for effective manipulation by a user.

Figure 13:
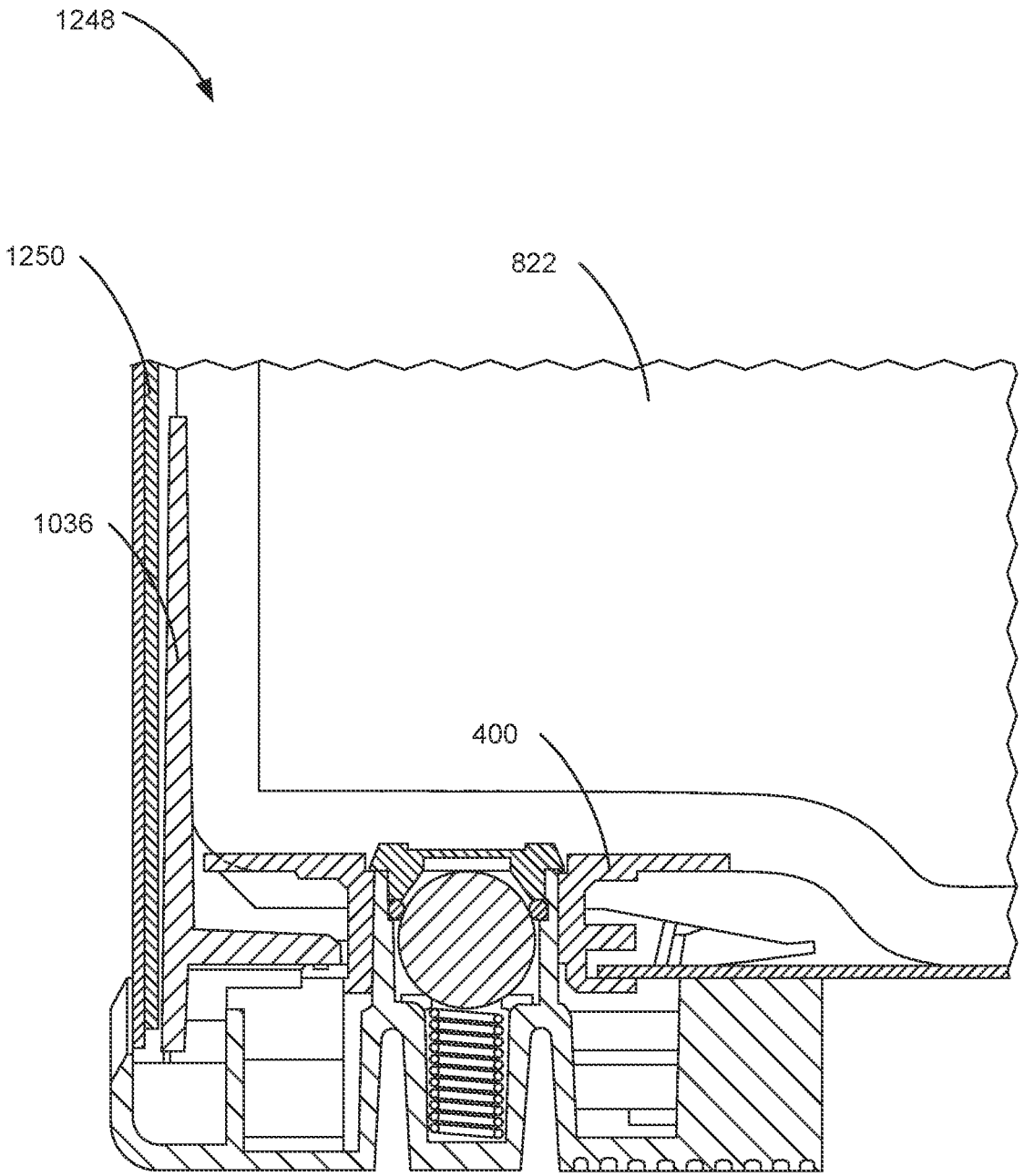
FIG. 13 is a cross-sectional view of a bag-in-box print liquid supply according to an example of the principles described herein.

FIG. 13 is a cross-sectional view of a bag-in-box print liquid supply (1348) according to an example of the principles described herein. Specifically, FIG. 13 is a cross-section taken along the line A-A from FIG. 12. As depicted in FIG. 13, the bag-in-box print liquid supply (1248) includes the pliable reservoir (822), the container (1250) in which the reservoir is disposed (822), the clamp plate (1036) as described above, and the spout (400) as described above.

FIG. 14 is an isometric view of different bag-in-box print liquid supplies (1248-1, 1248-2, 1248-3, 1248-4) upon insertion into a printing device, according to an example of the principles described herein. As described herein, the print liquid supplies (1248) provide the print liquid to a printing device or other ejection device. Accordingly, in some examples, a printing device or other ejection device includes ports to receive the print liquid supplies (1248). The slots may have a uniform size opening. Accordingly, the dimension of each print liquid supply container (1250-1, 1250-2, 1250-3, 1250-4), regardless of the volume, may have a size to fit in the opening. That is, each container (1250) depicted in FIG. 14 has a different volume on account of them having different lengths. However, the dimensions of each container (1250) that align with the opening in the port is the same. In some example, the front surface, i.e., the surface exposed to a user, may have an aspect ratio of at least 1.1. As a specific example, each container (1250) face may have an aspect ratio of between 1.5 and 2.0. That is, the height of the container (1250) may be 1.5 to 2 times greater than the width of the container (1250). By having the container (1250) with the same front surface shape and size, regardless of a length, and therefore volume, a variety of volumes of print supplies can be used in a given supply port. That is, rather than being limited to a size of a print supply, a port can accept a variety of containers (1250) having different volumes, each with the same front surface size and shape.

FIG. 14 also depicts the location of the spouts (FIG. 4, 400). That is, the spouts (FIG. 4, 400) may be disposed under the caps (1452) depicted in FIG. 14. In some examples described herein, the caps (1452) may also be referred to as a liquid bag interface. Accordingly, as depicted in FIG. 14, the spouts (FIG. 4, 400) may be disposed at a corner of the reservoir (FIG. 8, 822), such that upon insertion of reservoir (FIG. 8, 822) into the container (1250), the spout (FIG. 4, 400) is at a corner of the container (1250) that is to be adjacent an opening of the port. Still further, the spout (FIG. 4, 400) may be disposed at a corner of the reservoir (FIG. 8, 822) such that upon insertion of the reservoir (FIG. 8, 822) into the container (1250), the spout is at a corner of the container (1250) that is to be adjacent to a bottom of the port. Doing so facilitates liquid flow out of the reservoir (FIG. 8, 822) as gravity will naturally draw the liquid down and out.

Figure 15:
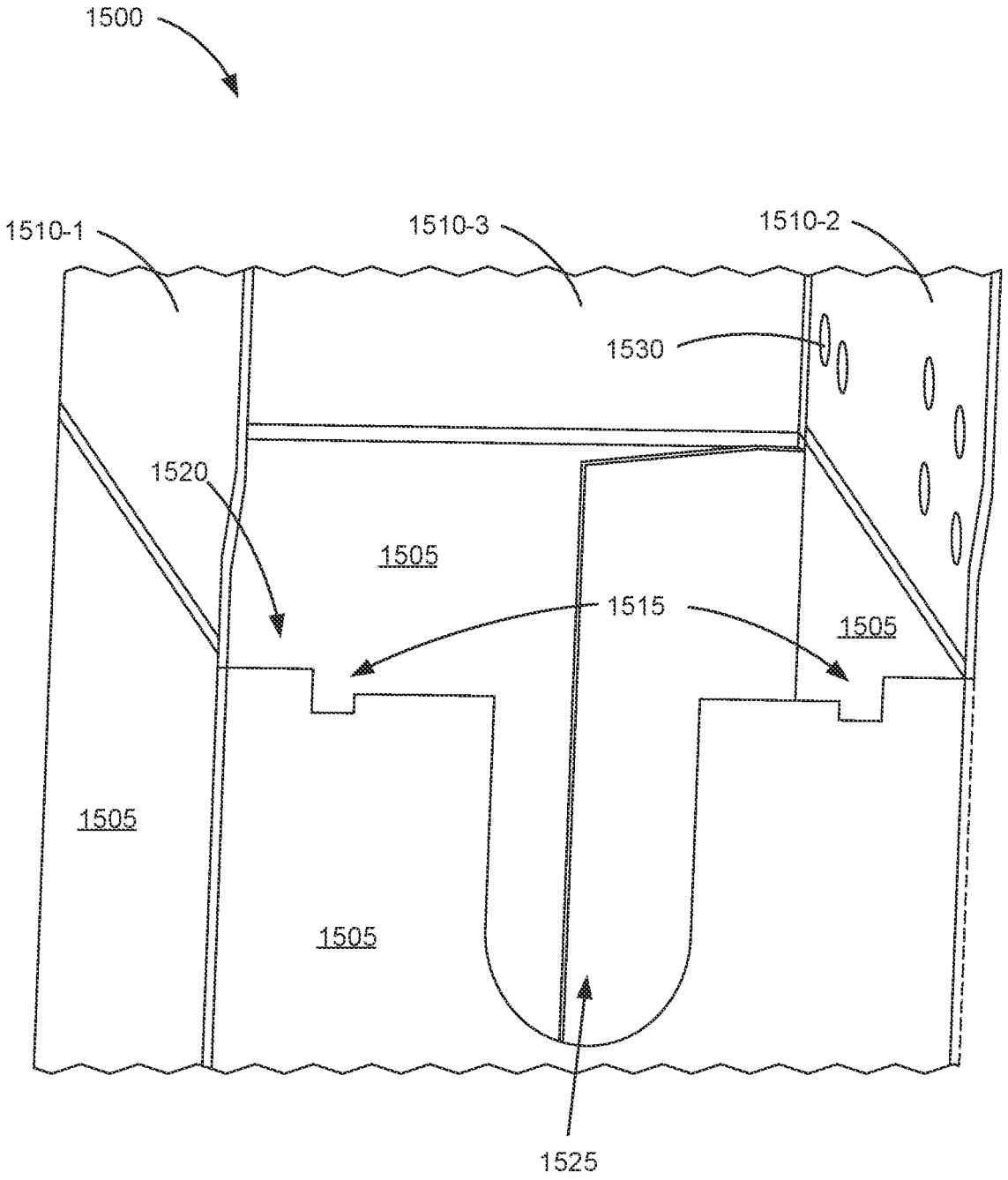
FIG. 15 is an isometric view of an opening of a bag-in-box print liquid supply according to an example of the principles described herein.

FIG. 15 is an isometric view of an opening of a bag-in-box print liquid supply (1500), according to an example of the principles described herein. As described herein, the bag-in-box print liquid supply (1500) may include a number of walls (1505) formed into a cuboid shape. In any example described herein, one of the walls (1505) of the cuboid shape may be formed by a number of flaps (1510-1, 1510-2, 1510-3), each of which when folded against each other form a wall (1505). In this example, the flaps (1510-1, 1510-2, 1510-3) may serve as an entry location for a pliable bag to be inserted into the bag-in-box print liquid supply (1500) during assembly of the bag-in-box print liquid supply (1500).

The bag-in-box print liquid supply (1500) may further include a number of alignment structures (1515) used to align a support element with the walls (1505) of the bag-in-box print liquid supply (1500). In an example, the support element includes the clamp plate (FIG. 10, 1036) described herein. In these examples, features formed on the clamp plate (FIG. 10, 1036) may fit within the alignment structures (1515) such that the clamp plate (FIG. 10, 1036) may fit therein and lie flush against the edge (1520) of the wall at which the alignment structures (1515) are cut into.

The bag-in-box print liquid supply (1500), in an example, includes a channel (1525) through which the spout (FIG. 4, 400) of the reservoir (FIG. 8, 822) may be placed along with the clamp plate (FIG. 10, 1036). In any example presented herein, the channel (1525) extends from the edge (1520) of a wall (1505) towards an opposite edge of the wall (1520) but not reaching a middle between the first and second edges. In any examples presented herein, the channel (1525) extends from the edge (1520) of a wall (1505) towards an opposite edge of the wall (1520) and may reach or exceed the middle between the first and second edges. In any example, the size of the bag (FIG. 3, 310) may determine the distance from one edge of the wall (1505) to another and, consequently, the length of the channel (1525) may be less than half that distance, half that distance, or more than half that distance. In an example where the bag (FIG. 3, 310) has a volume of 100 ml, the channel (1525) may extend past the middle between the edges of a wall (1505) by 4 mm.

In an example, the clamp plate (FIG. 10, 1036) may include a number of elongated alignment fingers formed thereon to interface with edges of the channel (1525) creating a fit between the clamp plate (FIG. 10, 1036) and a wall (1505) of the bag-in-box print liquid supply (1500).

In any example described herein, any number of flaps (1510-1, 1510-2, 1510-3) may include a number of holes (1530) or voids formed therein. The holes (1530) may be used to maintain an amount of adhesive material therein as the liquid impermeable liquid bag (310) is being closed. In an example, the adhesive material may be used to adhere one of the flaps (1510-1, 1510-2, 1510-3) to another as well as adhere flaps (1510-1, 1510-2, 1510-3) to the back plate (FIG. 10, 1040) of the clamp plate (FIG. 10, 1036). Once the adhesive material has cured, the bag-in-box print liquid supply (1500) may remain closed housing the pliable bag inside full of liquid.

Figure 16:
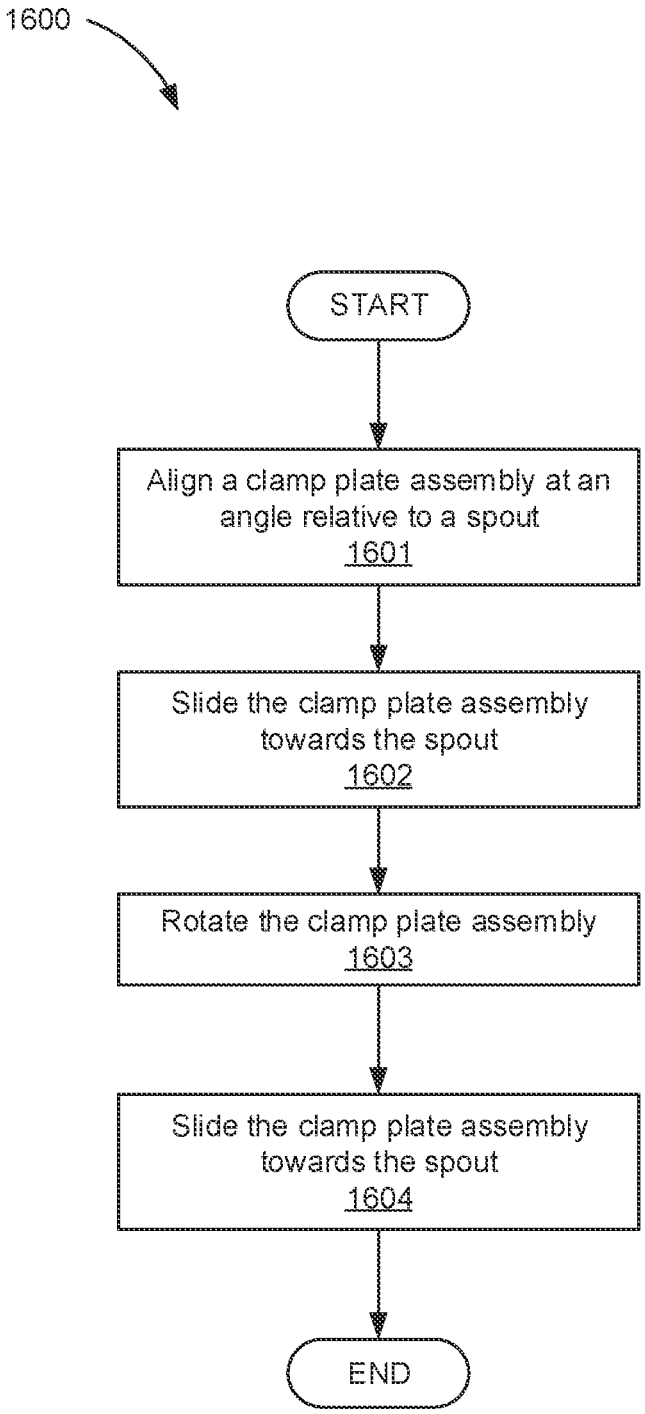
FIG. 16 is a flowchart of a method for assembling a print liquid supply according to an example of the principles described herein.

FIG. 16 is a flowchart of a method (1600) for assembling a print liquid supply, according to an example of the principles described herein. FIGS. 18A-19E are pictorial depictions of the operations of the method (1600). According to the method (1600), a clamp plate assembly (FIG. 10, 1034) is aligned (block 1601) at an angle to the spout (FIG. 4, 400). Specifically, the clamp plate assembly (FIG. 10, 1034) is aligned with the spout (FIG. 4, 400) such that the leading protrusions (FIG. 10, 1044) of the clamp plate (FIG. 10, 1036) are below the angled clamp flange (FIG. 4, 408) and the trailing protrusions (FIG. 10, 1046) of the clamp plate (FIG. 10, 1036) are aligned above the angled clamp flange (FIG. 4, 408) of the spout (FIG. 4, 400). Such an alignment is depicted in FIGS. 18A, 18B, 19A, and 19B.

The clamp plate assembly (FIG. 10, 1034) is slid (block 1602) towards the spout (FIG. 4, 400). That is, the clamp plate assembly (FIG. 10, 1034) is pushed along a direction indicated by the arrow towards the spout (FIG. 4, 400) as indicated in FIGS. 18C and 19C. In this example, the inward protrusions (FIG. 10, 1044, 1046) may deform around the spout (FIG. 4, 400). Doing so may ensure a snug fit once the spout (FIG. 4, 400) is fully seated in the end of the slot (FIG. 10, 1042) and ensure that the spout (FIG. 4, 400) does not slide out of the slot (FIG. 10, 1042).

The clamp plate assembly (FIG. 10, 1034) is slid (block 1602) in this direction until the leading protrusions (FIG. 10, 1044) align with the notches (FIG. 6, 616) in the angled clamp plate (FIG. 4, 408). When aligned, the clamp plate assembly (FIG. 10, 1034) is rotated (block 1603) such that the leading protrusions (FIG. 10, 1044) are above the angled clamp flange (FIG. 4, 408). Following such a rotation, both sets of protrusions (FIG. 10, 1044, 1046) are above the angled clamp flange (FIG. 4, 408). This rotation causes the container (FIG. 12, 1250) to be pinched between the clamp plate (FIG. 10, 1034) and the second flange (FIG. 4, 406) of the spout (FIG. 4, 400) thus assuring a rigid and secure interface. FIGS. 18D and 19D depict this state. During this state, a number of elongated alignment fingers (1970-1, 1970-2) may interface with the channels (1956-3).

The clamp plate assembly (FIG. 10, 1034) can then be further slid (block 1604) towards the spout (FIG. 4, 400) until the spout (FIG. 4, 400) is fully seated in the slot (FIG. 10, 1042). This sliding motion causes the wedge-shaped forked ends (FIG. 10, 1038) of the clamp plate (FIG. 10, 1036) to further compress the container (FIG. 12, 1250) between the clamp plate (FIG. 10, 1036) and the second flange (FIG. 4, 406), thus even more tightly securing the spout (FIG. 4, 400) to the container (FIG. 12, 1250). This is depicted in FIGS. 18E and 19E.

Figure 17:
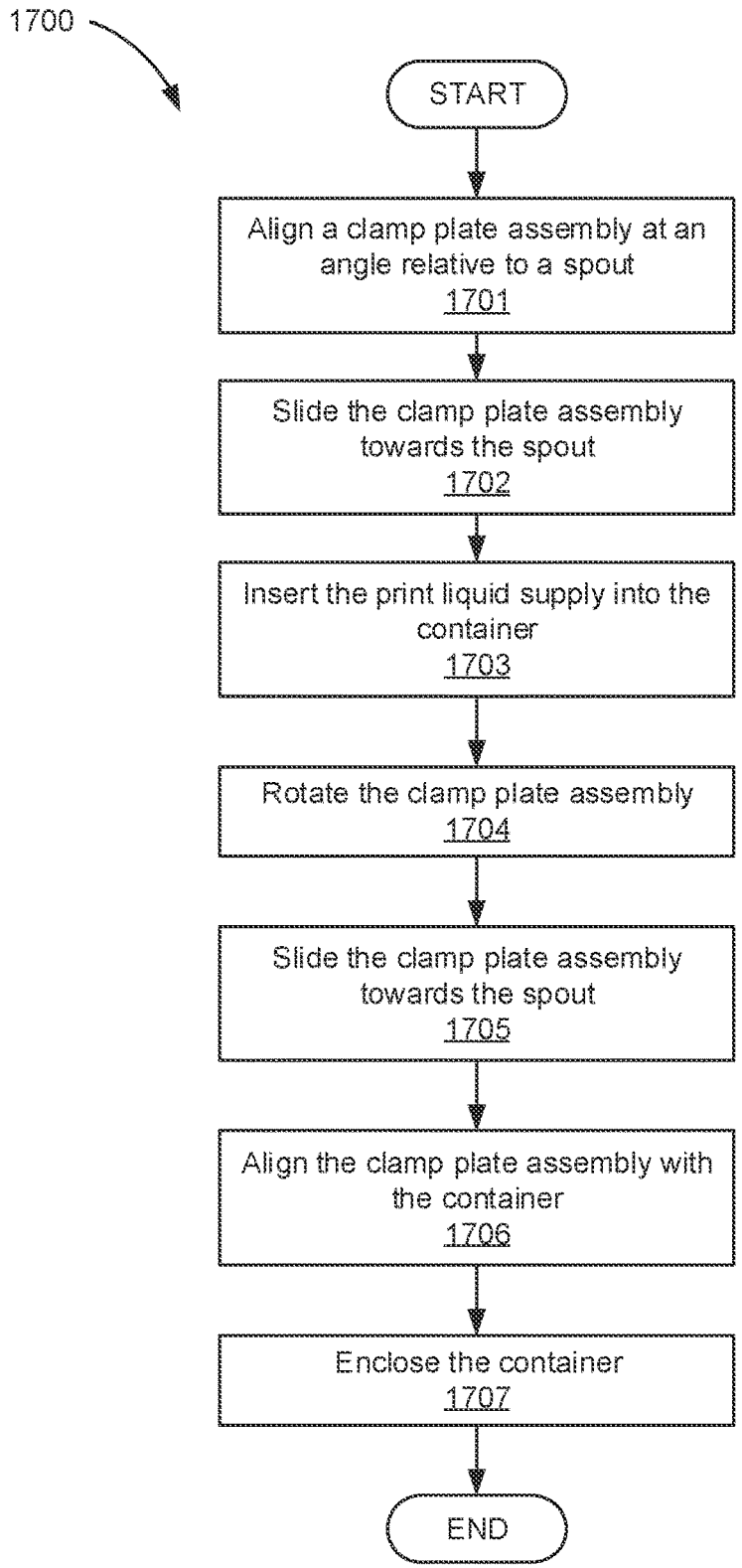
FIG. 17 is a flowchart of a method for assembling a print liquid supply according to an example of the principles described herein.

FIG. 17 is a flowchart of a method (1700) for assembling a print liquid supply, according to an example of the principles described herein. According to the method (1700), the clamp plate assembly (FIG. 10, 1034) is aligned (block 1701) at an angle relative to the spout (FIG. 4, 400) and the clamp plate assembly (FIG. 10, 1034) is slid (block 1702) towards the spout (FIG. 4, 400). This may be performed as described in connection with FIG. 16. Simultaneous to the sliding (block 1702) of the clamp plate assembly (FIG. 10, 1034) towards the spout (FIG. 4, 400) or after, the print liquid supply (FIG. 8, 820) is inserted (block 1703) into the container (FIG. 12, 1250). In so doing, the container wall is inserted into the window between flanges of the spout (FIG. 4, 400), specifically between the second flange (FIG. 4, 406) and the angled clamp flange (FIG. 4, 408). Accordingly, as the clamp plate assembly (FIG. 10, 1034) is rotated (block 1704) and slid (block 1705) towards the spout (FIG. 4, 400), the angle of the angled clamp flange (FIG. 4, 408) causes the clamp plate (FIG. 10, 1036) to compress the container (FIG. 12, 1250) against the second flange (FIG. 4, 406), thus ensuring a snug joining of the container (FIG. 12, 1250) and the spout (FIG. 4, 400). As the clamp plate assembly (FIG. 10, 1034) is slid (block 1705) towards the spout (FIG. 4, 400) and inserted into the container (FIG. 12, 1250), the clamp plate assembly (FIG. 10, 1034) is aligned (block 1706) with the container (FIG. 12, 1250) such that the clamp plate assembly (FIG. 10, 1034) and spout (FIG. 4, 400) are properly seated in a desired location. That is, protrusions (FIG. 10, 1044, 1046) on the clamp plate (FIG. 10, 1036) are fitted into slots in the container (FIG. 12, 1250) to ensure a desired alignment of the spout (FIG. 4, 400).

Once seated, the container (FIG. 12, 1250) is enclosed (block 1707). That is, foldable flaps (FIG. 2, 210) of the container (FIG. 12, 1250) may be folded over and sealed to retain the reservoir (FIG. 8, 822) and other components inside the container (FIG. 12, 1250).

Figure 18A:
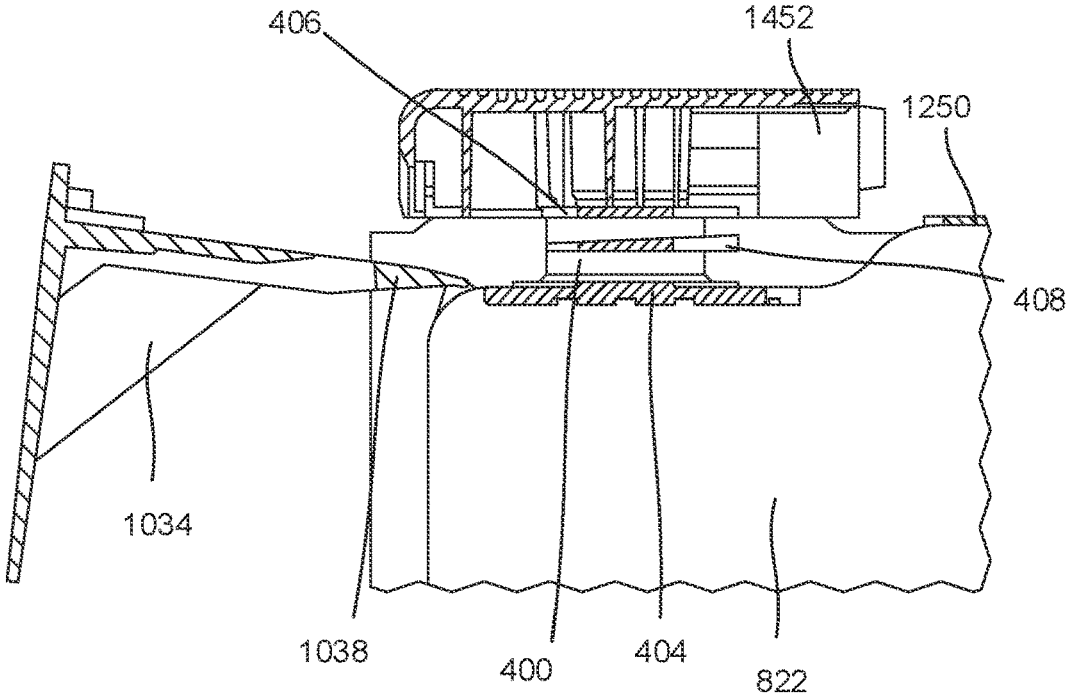
FIGS. 18A-18F illustrate cross-sectional views of the assembly of a print liquid supply according to an example of the principles described herein.
Figure 18B:
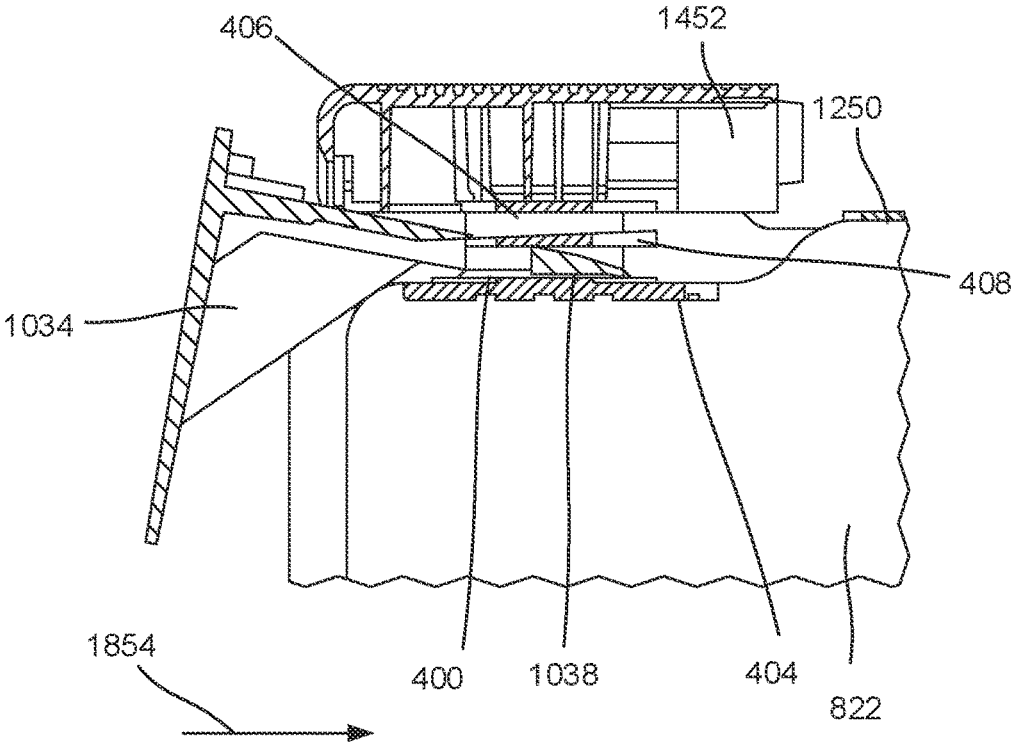
Figure 18C:
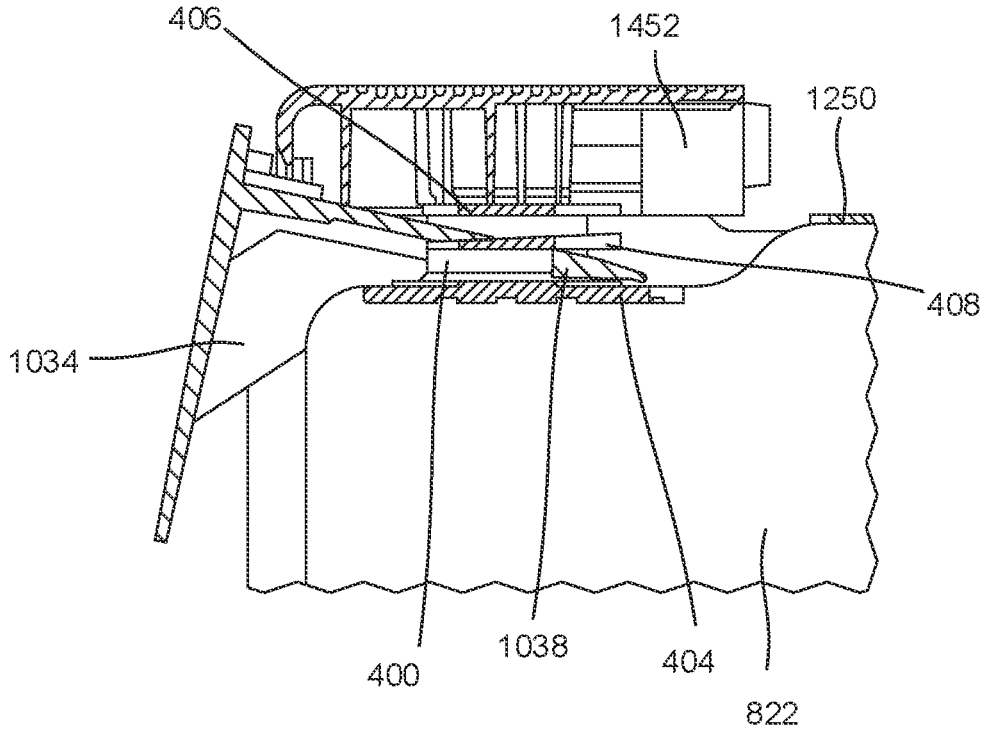
Figure 18D:
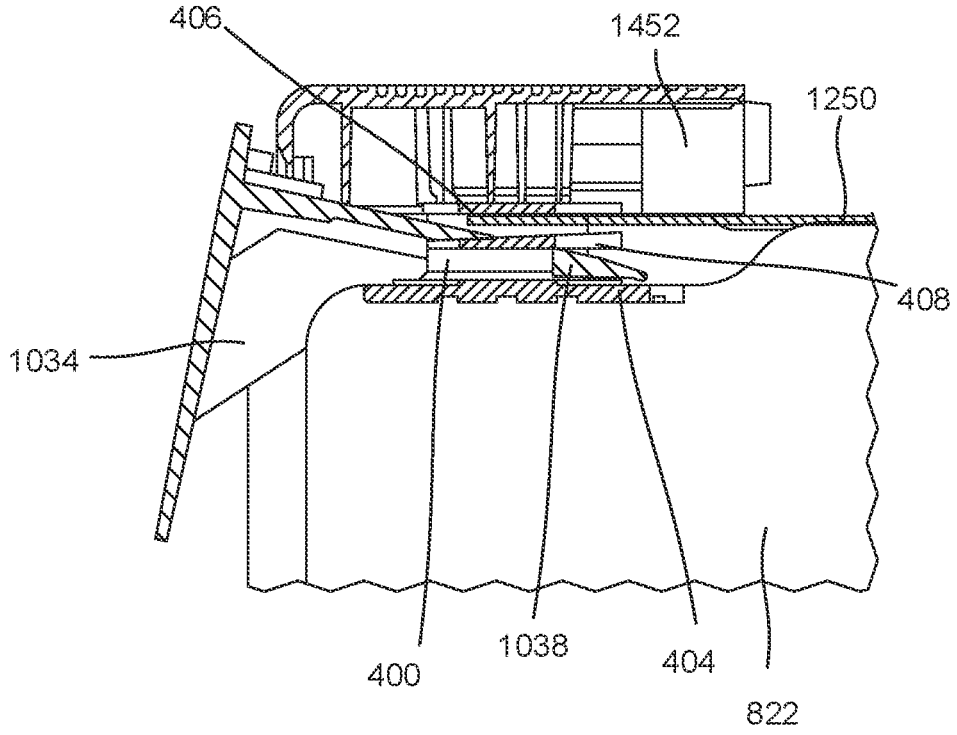
Figure 18E:
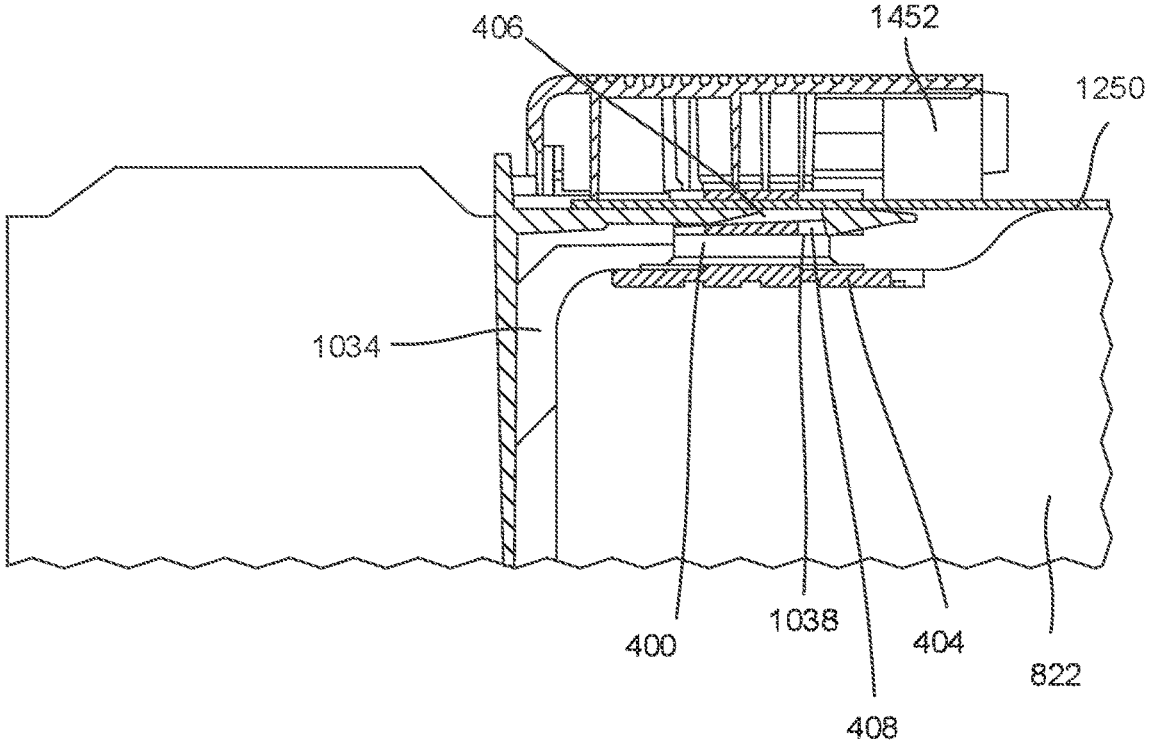

FIGS. 18A-18F illustrate cross-sectional views of the assembly of a print liquid supply (FIG. 12, 1248), according to an example of the principles described herein. As described above, the print liquid supply (FIG. 12, 1248) includes many components such as a reservoir (822), a spout (400), and a clamp plate assembly (1034) that are all, at least partially disposed within a container (1250). The system also includes a cap (1452) that provides an interface between the printing device in which the supply is inserted. As depicted in FIG. 18A, the spout (400) has been attached to the reservoir (822) via a staking or other operation such that the first flange (404) is disposed on an inside of the reservoir (822). FIG. 18A also clearly depicts the angle of the wedge-shaped forked ends (1038). In some examples, the angle of these wedge-shaped ends (1038) matches an angle of the angled surface (FIG. 5, 510) of the angled clamp flange (408).

As depicted in FIG. 18A, the clamp plate assembly (1034) is aligned at an angle relative to the spout (400). Specifically, they are aligned such that as the clamp plate assembly (1034) is slid forward in a direction indicated by the arrow (1854) in FIG. 18B, leading protrusions (FIG. 10, 1044) on the clamp plate assembly (1034) are aligned below the angled clamp flange (408) and the trailing protrusions (FIG. 10, 1046) on the clamp plate assembly (1034) are aligned above the angled clamp flange (408). Doing so creates a large window in which the container (1250) can be inserted. Put another way, during a first stage of insertion of the clamp plate assembly (1034), the straight surface (FIG. 5, 512) of the angled clamp flange (408) interfaces with the leading protrusions (FIG. 10, 1044) on the clamp plate (1036) to maintain the clamp plate assembly (1034) at a non-parallel angle relative to the angled clamp flange (408). The clamp plate assembly (1034) will remain in this angled orientation until the leading protrusions (FIG. 10, 1044) align with the notches (FIG. 6, 616) in the angled clamp flange (408) as depicted in FIG. 18C.

With the clamp plate assembly (1034) still at an angle relative to the spout (400), the two halves, i.e., 1) the container (1250) and 2) the reservoir (822), spout (400), and clamp plate assembly (1034) may be pressed together. The relative motion of these halves together moves the container (1250) underneath the second flange (406), but on top of the angled clamp flange (408) and the clamp plate assembly (1034) as indicated in FIG. 18D. As indicated in FIG. 18D, were the clamp plate assembly (1034) not angled, the space in which the container (1250) would be inserted would be much narrower, thus resulting in a more complex and less likely insertion process.

Once the reservoir (822), spout (400), and clamp plate assembly (1034) are fully seated, i.e., when the spout (400) is fully seated in the alignment slot in the container and the leading protrusions (FIG. 10, 1044) align with the notches (FIG. 6, 616), the clamp plate assembly (1034) is rotated to be parallel with the container (1250) wall and the second flange (406) as depicted in FIG. 18E. As depicted in FIG. 18E, this compresses the container (1250) between the clamp plate (1036) and the spout (400).

Figure 18F:
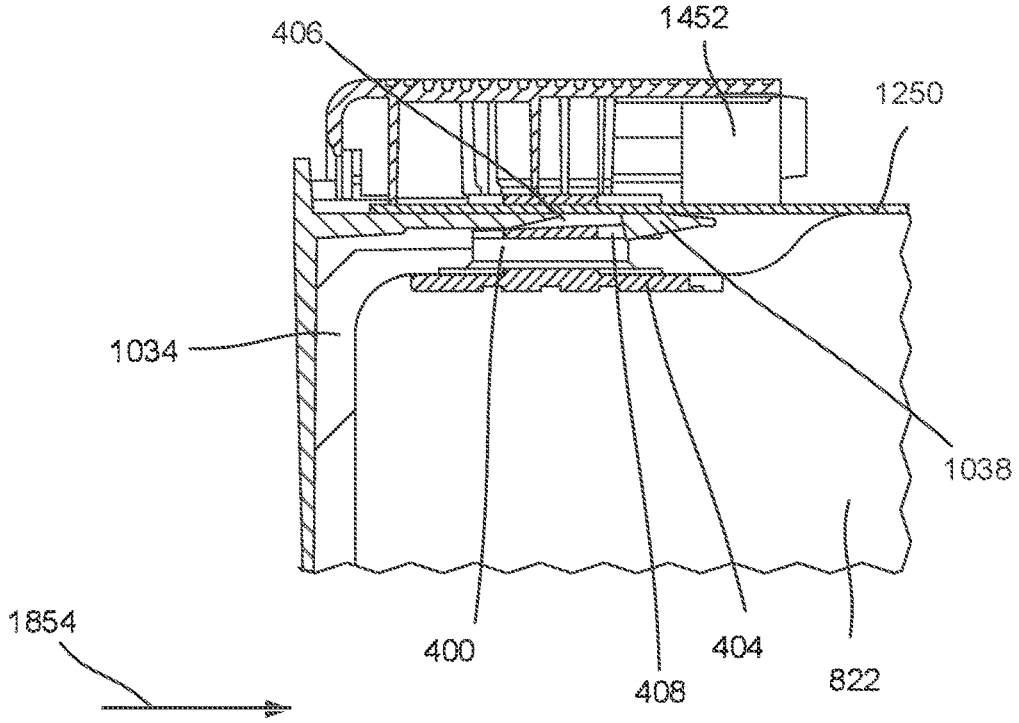

The clamp plate assembly (1034) can again be slid along the arrow (1854) as depicted in FIG. 18F. Due to the wedge-shape of the angled clamp flange (408) and the wedge-shaped ends (1038), this further compresses the container (1250) between the clamp plate (1036) and second flange (406), which compression more securely affixes the spout (400) in place to the container (1250), ensuring that the spout (400) does not move, i.e., translate, rotate, etc. relative to the container (1250). In this fashion, a rigid interface is provided between a spout (400) of a pliable reservoir (822) and the ejection device into which the reservoir (822) is ultimately inserted. The immovable coupling ensures accurate, and discernable, placement of the spout (400) such that effective liquid delivery is possible.

Figure 19A:
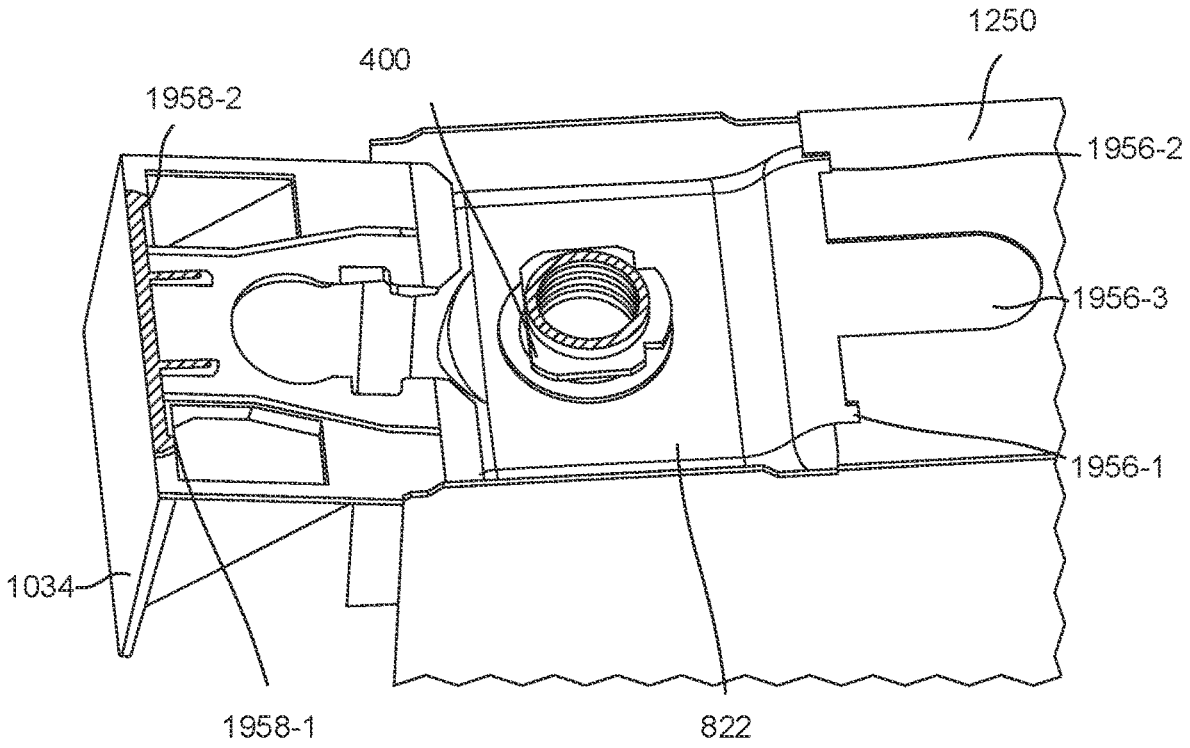
FIGS. 19A-19E illustrate an isometric view of the assembly of a print liquid supply according to an example of the principles described herein.
Figure 19B:
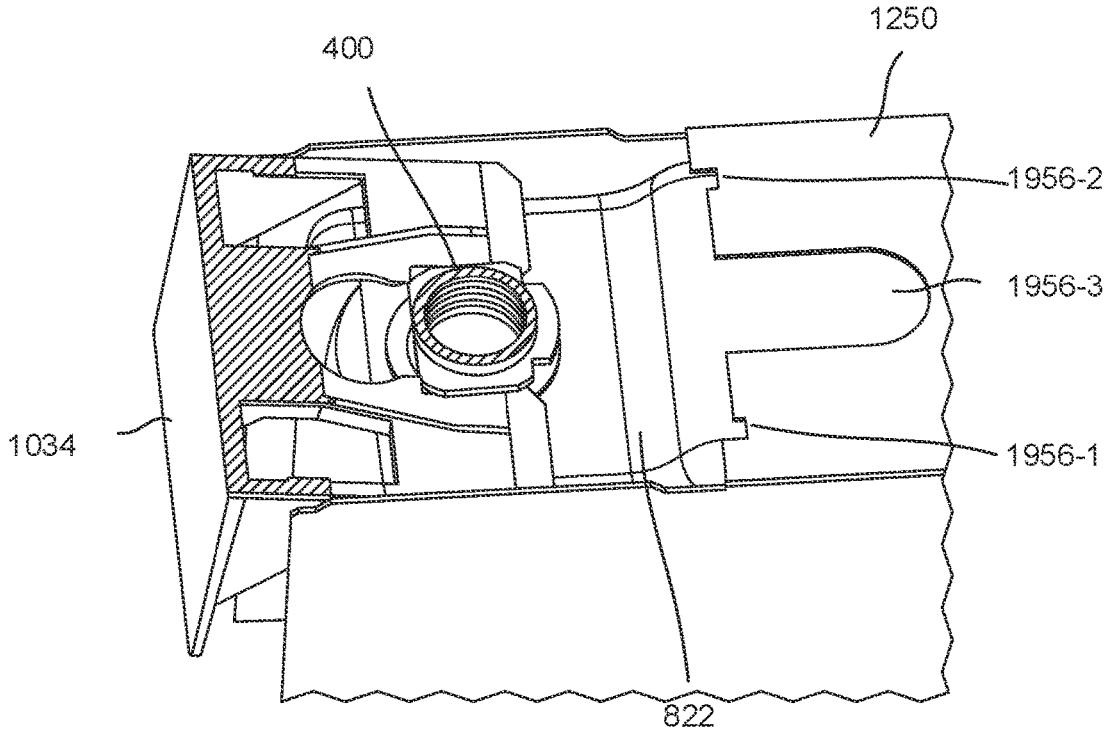
Figure 19C:
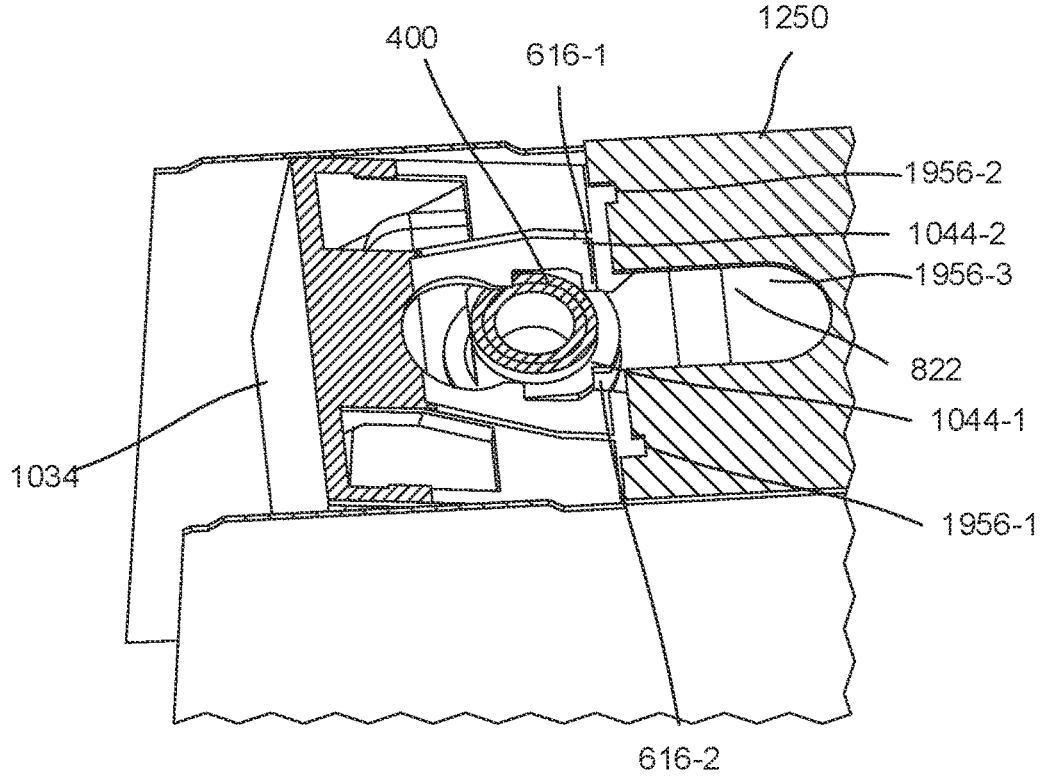
Figure 19D:
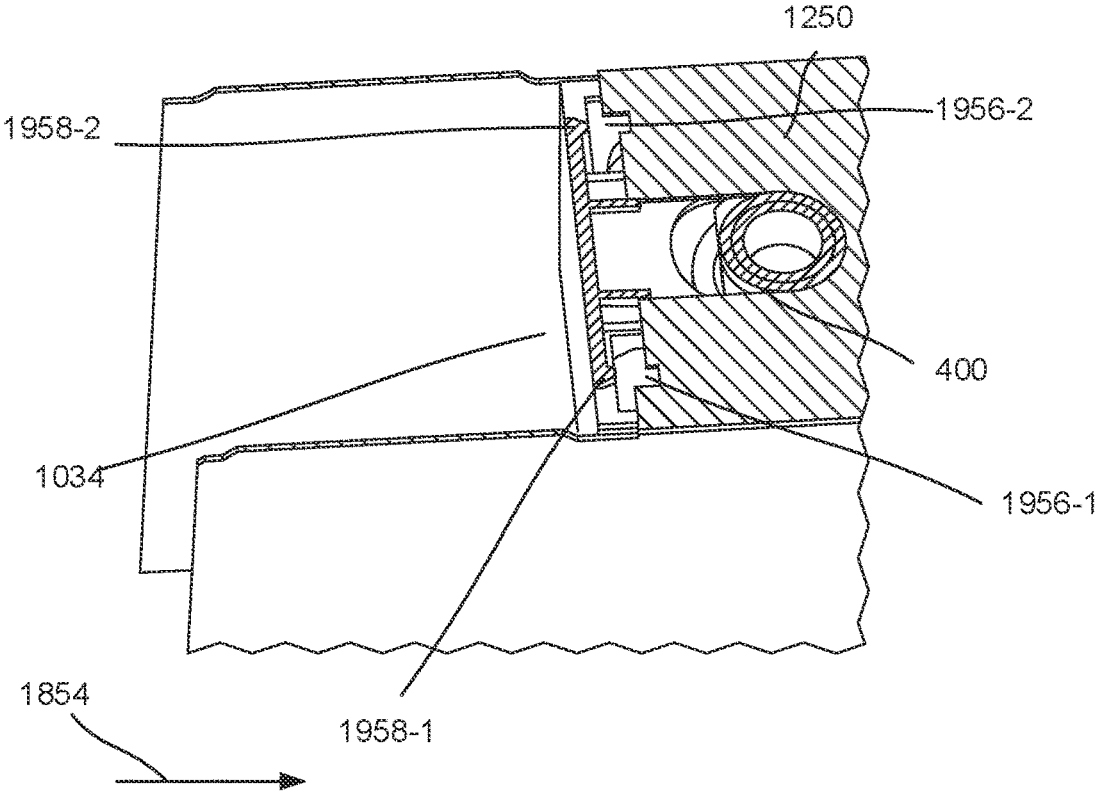
Figure 19E:
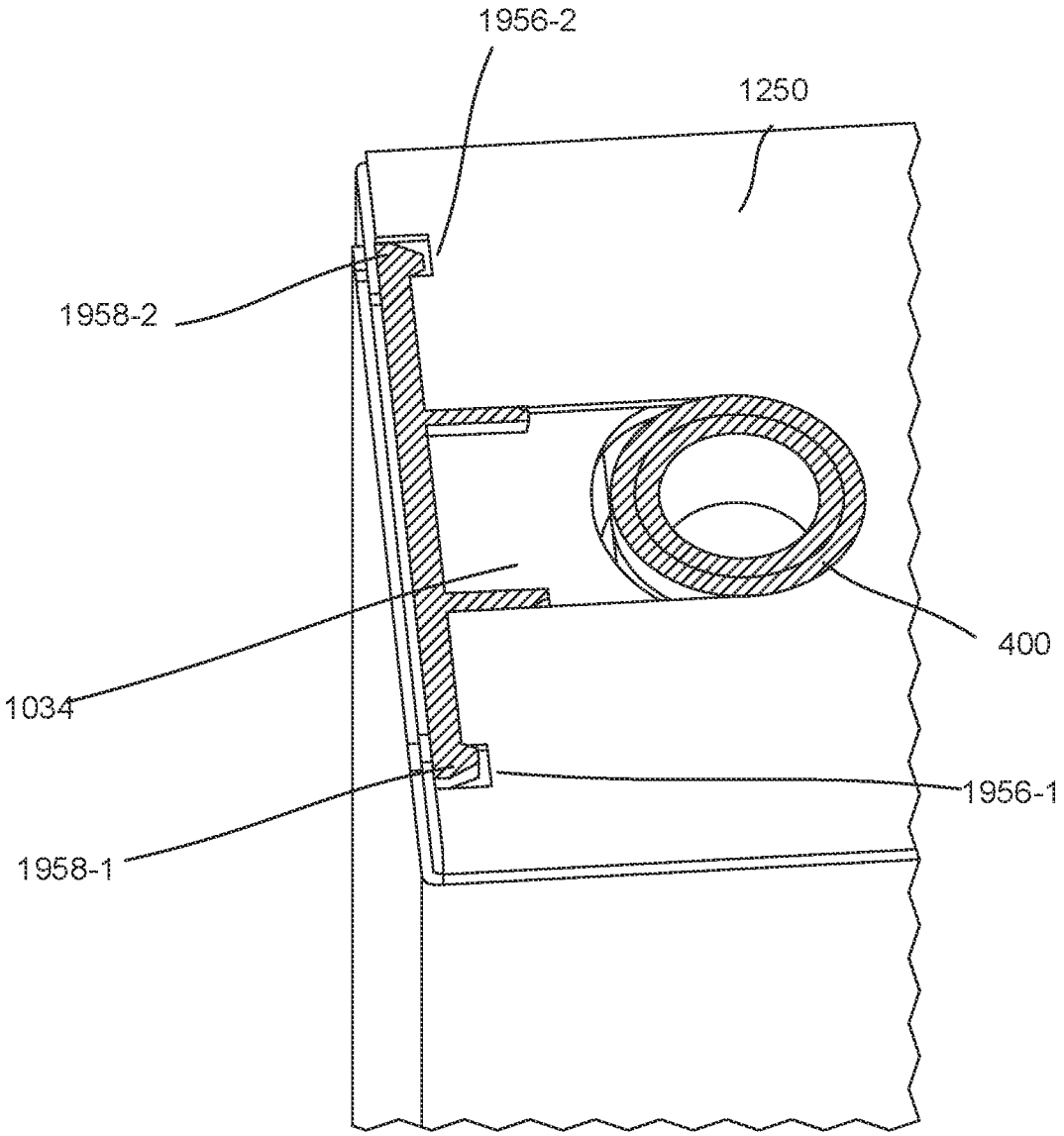

FIGS. 19A-19E illustrate an isometric view of the assembly of a print liquid supply, according to an example of the principles described herein. As explained above, in a first stage of insertion, the clamp plate assembly (1034) is rotated relative to the spout (400) as depicted in FIG. 19A. FIG. 19A also depicts the alignment mechanism on the container (1250). The alignment mechanism on the container (1250) positions the spout (400) at a predetermined location during the insertion of the pliable reservoir (822). Such a predetermined location may be near an opening of a port in which the bag-in-box print liquid supply is received. Putting the spout (400) at the front of the port allows for liquid supplies with different lengths to be inserted into the port easily by a user. For example, were the spout (400) near the back of a port, a user would have to extend their hand fully inside the port to insert a smaller liquid supply.

As indicated in FIG. 19A the alignment mechanism is a channel (1956-3) that receives the spout (400) and slots (1956-1, 1956-2) to receive alignment protrusions (1958-1, 1958-2) of the clamp plate assembly (1034). As depicted in FIG. 19B, the clamp plate assembly (1034) is slid towards the spout (400) until the leading protrusions (1046) align with the notches (616) as indicated in FIG. 19C. As described above the clamp plate assembly (1034) can then be rotated and the entire spout (400), clamp plate (1034), and reservoir (822) assembly slid into place as indicated in FIG. 19D.

FIG. 19D also clearly illustrates the operation of the alignment system. Specifically, the container (1250) includes a channel (1956-3) to receive the spout (400). This same channel (1956-3) may receive some of the alignment protrusions on the clamp plate assembly (1034). That is the clamp plate assembly (1034) may include multiple alignment protrusions, some received into the channel (1956-3) where the spout (400) is disposed and some received into other slots (1956-1, 1956-2). These alignment protrusions (1958-1, 1958-2) mate with these slots (1956-1, 1956-2) during the insertion of the reservoir (FIG. 8, 822) into the container (1250).

FIG. 19E illustrates the closure of the bag-in-box print liquid supply. Specifically, in some examples, the container (1250) includes a foldable opening through which the pliable reservoir (822) is inserted. Accordingly, once the spout (400), clamp plate assembly (1034), and reservoir (822) are fully inserted and properly aligned with the container (1250), the foldable opening may be closed and sealed. In this example, upon closing the first flange (FIG. 4, 404) and angled clamp flange (FIG. 4, 408) as well as the clamp plate assembly (1034) are enclosed within the container (1250).

Figure 20A:
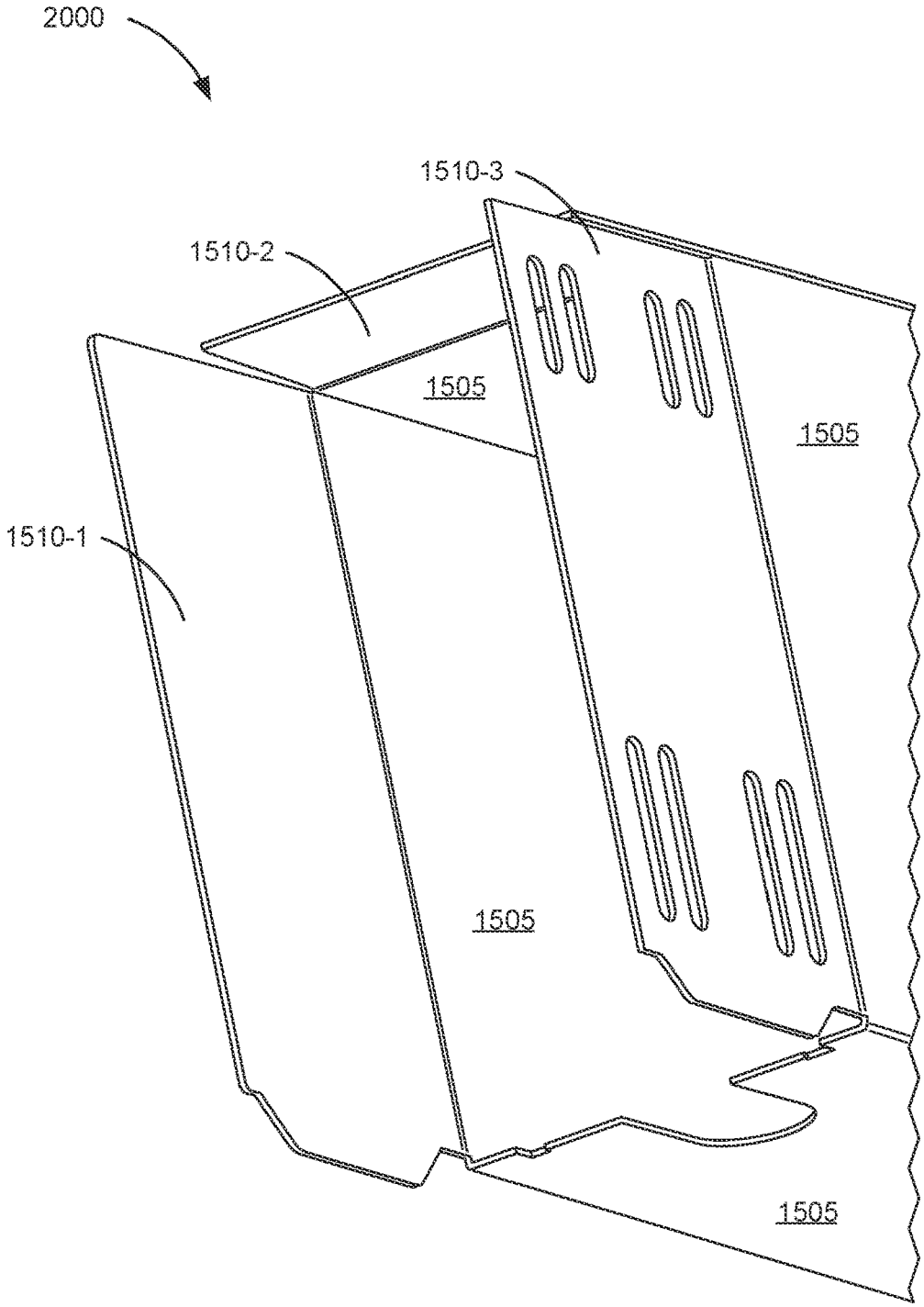
FIGS. 20A-20D illustrate a number of isometric views of the closure of a carton fold structure according to an example of the principles described herein.

FIGS. 20A-20D illustrate a number of isometric views of the closure of a carton fold structure (200) according to an example of the principles described herein. FIG. 20A shows the carton fold structure (2000) in a folded and open orientation. In this example, the walls (FIG. 15, 1505) may be formed by folding a cardboard material into a cuboid shape. In some examples, fold lines may be formed into a sheet of cardboard material such that five of the six sides of the cuboid-shaped carton fold structure (2000) may be formed. Adhesives may be used to secure any of the number of walls (FIG. 15, 1505) to obtain a form of that shown in FIG. 20A.

As described herein, flaps (1510-1, 1510-2, 1510-3) may extend out from a number of the walls (FIG. 15, 1505). The flaps (1510-1, 1510-2, 1510-3) may server, together, to form a sixth wall (FIG. 15, 1505) of the carton fold structure (2000) when assembled. Prior to closure of the carton fold structure (2000), however, the clamp plate (FIG. 10, 1036), spout (FIG. 4, 400), and pliable reservoir (FIG. 8, 822) may be assembled and fit into the channel (FIG. 19A, 1956-3) as described herein.

Figure 20B:
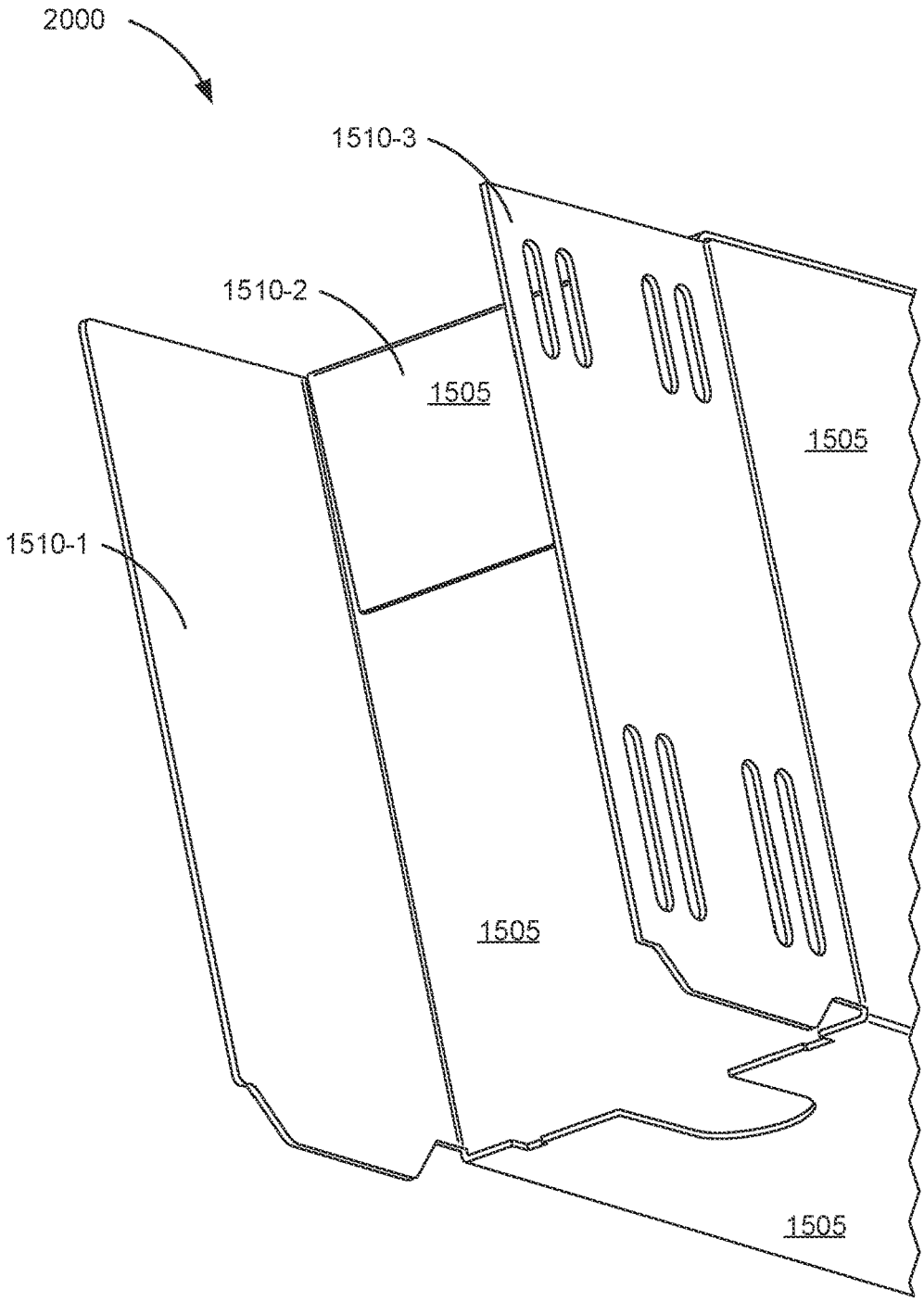
Figure 20C:
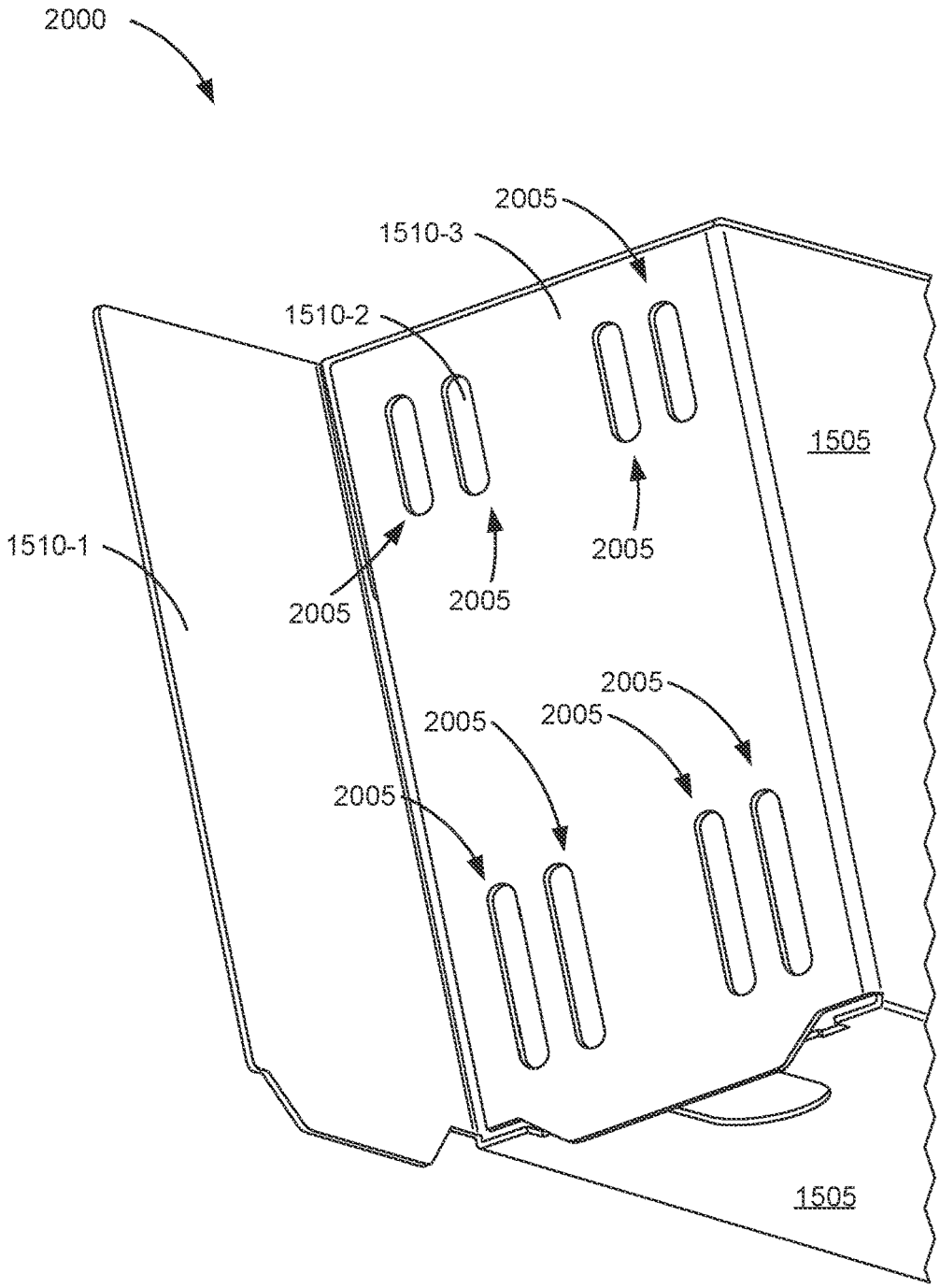

FIG. 20B illustrates the closure of a second flap (1510-2) after the clamp plate (FIG. 10, 1036), spout (FIG. 4, 400), and pliable reservoir (FIG. 8, 822) have been secured in the channel (FIG. 19A, 1956-3). FIG. 20C illustrates the closure of a third flap (1510-3) after the closure of the second flap (1510-2). In an example, prior to closing the third flap (1510-3), an adhesive may be deposited onto the second flap (1510-2) such that when a surface of the second flap (1510-2) having the adhesive contacts a surface of the third flap (1510-3), the second flap (1510-2) and third flap (1510-3) may be secured. Alternatively, an adhesive material may be deposited onto a surface of the third flap (1510-3) in a later process. In this example, an adhesive material may be placed on the surface of the third flap (1510-3) and made to pool within and without a number of voids or holes (2005) formed in the third flap (1510-3).

Figure 20D:
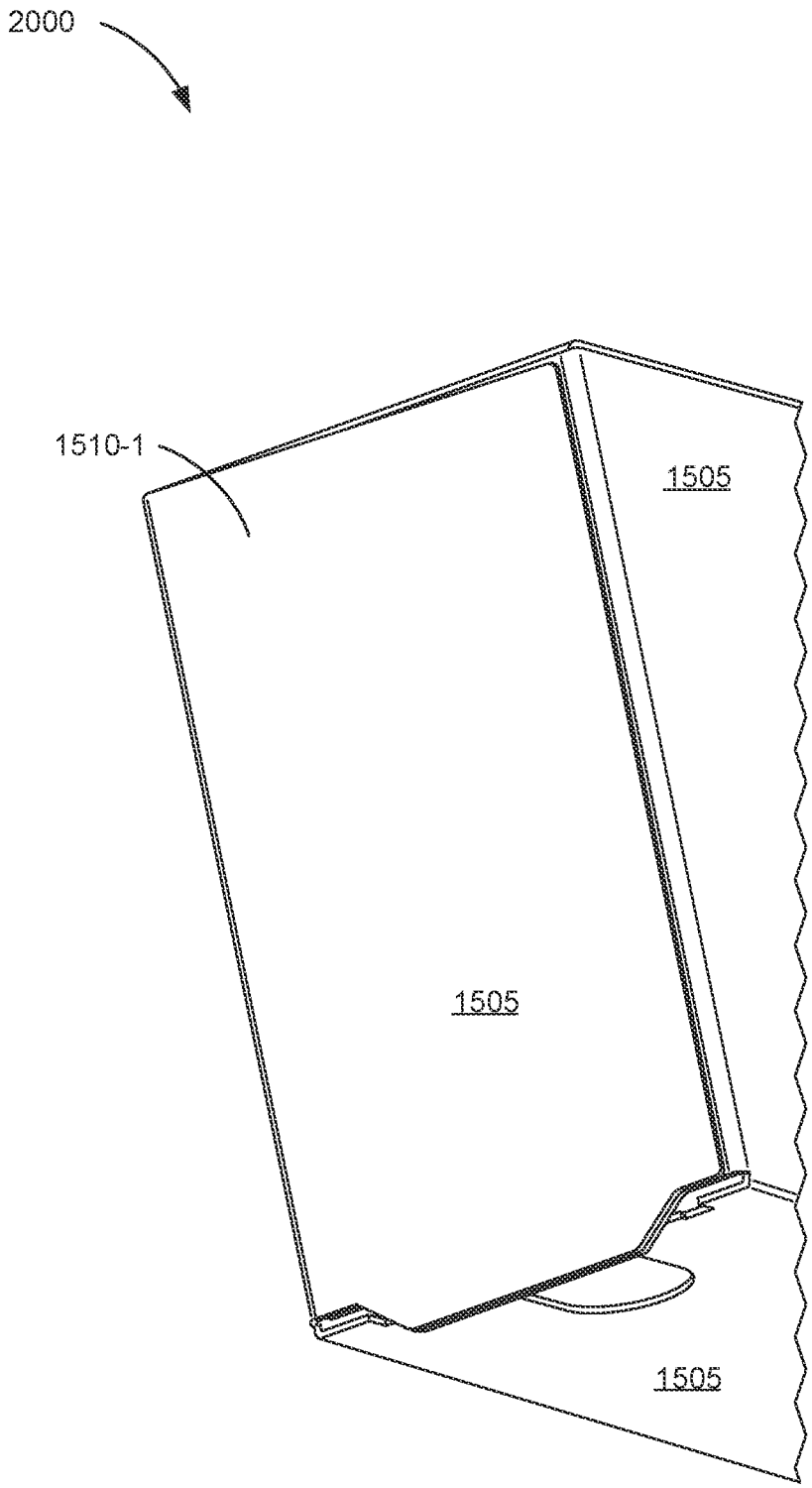

FIG. 20D shows the closure of a first flap (1510-1). Depending on when the adhesive material is placed, the first flap (1510-1) may be secured to the second flap (1510-2) and third flap (1510-3) via the adhesive. Specifically, the adhesive may be allowed to contact adjoining surfaces among the first flap (1510-1), second flap (1510-2), and third flap (1510-3) as well as through the holes (2005). Curing of the adhesive causes the adjoining surfaces of the first flap (1510-1), second flap (1510-2), and third flap (1510-3) to be coupled together. Adhesive may also be placed between the first flap (1510-1), second flap (1510-2), and back plate (FIG. 10, 1040) of the clamp plate assembly (FIG. 10, 1034) to secure the flaps (1510-1, 1510-2, 1510-3) thereto.

In summary, such a spout 1) is rigidly coupled to a print liquid reservoir; 2) facilitates a non-rotating, non-translating spout relative to a container in which the reservoir is disposed; 3) promotes a simple installation of a print liquid supply into a liquid ejection system; and 4) is easily manufactured with a small number of parts and few operations.

The specification and figures describe a box having a number of alignment structures cutout on an edge of a plane to accommodate a support element. Proper location of the support element relative to the box allows for the box to maintain a pliable bag therein while simultaneously being facile enough for a user to insert into a printer interface. The user may more accurately insert the box into the interface without the box being resistant to change in orientation or damaged while being inserted. The box may be relatively easier to manufacture due to interface of the support element to the box.

The preceding description has been presented to illustrate and describe examples of the principles described. This description is not intended to be exhaustive or to limit these principles to any precise form disclosed. Many modifications and variations are possible in light of the above teaching.

What is claimed is:

1. A print liquid supply, comprising:

a reservoir for holding a supply of print liquid, the reservoir comprising a pliable body having a front face and a back face;

a spout affixed to the reservoir, wherein:

the spout is located at a corner of the front face offset from a centerline of the front face; and the spout comprises:

a first flange extending to affix the spout to the reservoir; and multiple additional flanges to affix the spout and reservoir to a container in which the reservoir is disposed, wherein a clamp plate and a surface of the container are disposed between the multiple additional flanges.

2. The print liquid supply of claim 1, wherein the spout is located at a same offset distance from at least one respective edge, independent of a maximum liquid volume capacity for the reservoir.

3. The print liquid supply of claim 1, wherein the corner is adjacent to an opening of the container in which the reservoir is inserted.

4. The print liquid supply of claim 1, wherein the spout is:

at least 15 millimeters from a top edge of the reservoir;

at least 15 millimeters from a side edge of the reservoir; and offset more than 0 millimeters and 60 or less millimeters from a centerline of the reservoir.

5. The print liquid supply of claim 1, wherein one of the additional flanges is an angled clamp flange to locate the spout relative to the container.

6. The print liquid supply of claim 1, wherein the first flange has a diameter that is greater than a diameter of the multiple additional flanges.

7. The print liquid supply of claim 1, further comprising a clamp plate comprising two forked ends to facilitate clamping the spout to the container in which the reservoir is disposed.

8. The print liquid supply of claim 7, wherein the two forked ends are wedge-shaped.

9. The print liquid supply of claim 7, further comprising a leading protrusion on each forked end of the clamp plate.

10. The print liquid supply of claim 9, wherein one of the additional flanges comprises a notch to receive the leading protrusion to allow the clamp plate to rotate upon insertion of the reservoir into the container.

11. A bag-in-box print liquid supply, comprising:

a pliable reservoir for holding a supply of print liquid, the pliable reservoir comprising:

a pliable body having a front face and a back face; and a spout affixed to the reservoir, wherein:

the spout is located at a corner of the front face offset from a centerline of the front face; and the spout comprises:

a sleeve having an opening through which print liquid passes;

a first flange extending outward from the sleeve to affix the spout to the reservoir; and multiple additional flanges to affix the spout and reservoir to a container in which the reservoir is disposed, wherein a clamp plate and a surface of the container are disposed between the multiple additional flanges; and a container in which the pliable reservoir is at least partially disposed.

12. The supply of claim 11, wherein the container comprises a channel cutout extending inwards from an edge of the container to receive the spout.

13. The supply of claim 11, wherein the container comprises slots intending inwards from an edge of the container to receive protrusions of a clamp plate.

14. A print liquid supply, comprising:

a reservoir for holding a supply of print liquid, the reservoir comprising a pliable body having a front face and a back face;

a spout affixed to the reservoir, wherein:

the spout is located at a corner of the front face offset from a centerline of the front face; and the spout comprises:

a first flange extending to affix the spout to the reservoir;

a second flange extending outward from the spout to sit on a wall of a container in which the reservoir is disposed; and an angled clamp flange having an angled surface and a straight surface opposite the angled surface, the angled clamp flange to affix the spout to the container.

15. The print liquid supply of claim 14, wherein a clamp plate and a surface of the container are disposed between the second flange and the angled clamp flange.

* * * * *